US008828294B2

(12) United States Patent
Lozano et al.

(10) Patent No.: US 8,828,294 B2
(45) Date of Patent: Sep. 9, 2014

(54) SUPERFINE FIBER CREATING SPINNERET AND USES THEREOF

(75) Inventors: Karen Lozano, McAllen, TX (US); Kamalaksha Sarkar, Edinburg, TX (US)

(73) Assignee: Board of Regents of the University of Texas System, Austin, TX (US)

( * ) Notice: Subject to any disclaimer, the term of this patent is extended or adjusted under 35 U.S.C. 154(b) by 2 days.

(21) Appl. No.: 13/527,167

(22) Filed: Jun. 19, 2012

(65) Prior Publication Data

US 2013/0001814 A1 Jan. 3, 2013

Related U.S. Application Data

(63) Continuation of application No. 12/404,948, filed on Mar. 16, 2009, now Pat. No. 8,231,378.

(60) Provisional application No. 61/037,184, filed on Mar. 17, 2008, provisional application No. 61/037,193, filed on Mar. 17, 2008, provisional application No. 61/037,209, filed on Mar. 17, 2008, provisional application No. 61/037,216, filed on Mar. 17, 2008.

(51) Int. Cl.
*D01D 5/18* (2006.01)

(52) U.S. Cl.
USPC ..... 264/211.1

(58) Field of Classification Search
CPC ..... D01D 5/18
USPC ..... 264/8, 639, 172.17, 211.1; 425/172.17, 425/378, 378.2
See application file for complete search history.

(56) References Cited

U.S. PATENT DOCUMENTS

| | | | | |
|---|---|---|---|---|
| 2,609,566 | A | 9/1952 | Slayter et al. | |
| 3,245,112 | A | 4/1966 | Williamson | |
| 3,388,194 | A | 6/1968 | Vinicki | |
| 3,428,724 | A | 2/1969 | Billheimer | |
| 3,920,362 | A | 11/1975 | Bradt | |
| 4,043,331 | A | 8/1977 | Martin et al. | |
| 4,323,524 | A | 4/1982 | Snowden | |
| 4,323,525 | A | 4/1982 | Bornat | |
| 4,374,074 | A * | 2/1983 | Ueda et al. | 264/8 |
| 4,526,525 | A | 7/1985 | Oiso et al. | |
| 4,790,736 | A | 12/1988 | Keuchel | |
| 4,793,782 | A | 12/1988 | Sullivan | |
| 4,872,821 | A | 10/1989 | Weiss | |

(Continued)

FOREIGN PATENT DOCUMENTS

| | | |
|---|---|---|
| CN | 1472373 | 2/2004 |
| DE | 102005048939 | 1/2007 |

(Continued)

OTHER PUBLICATIONS

Badrossamay et al. "Nanofiber Assembly by Rotary Jet-Spinning" Nano Lett. 2010, 10, 2257-2261.

(Continued)

*Primary Examiner* — Amjad Abraham
*Assistant Examiner* — Alison Hindenlang
(74) *Attorney, Agent, or Firm* — Meyertons, Hood, Kivlin, Kowert & Goetzel, P.C.; Eric B. Meyertons

(57) ABSTRACT

Apparatuses and methods for the production of superfine fibers.

19 Claims, 27 Drawing Sheets

(TOP VIEW)

(SIDE VIEW)

(56) References Cited

U.S. PATENT DOCUMENTS

| | | | |
|---|---|---|---|
| 5,066,430 | A | 11/1991 | Matthews |
| 5,165,940 | A | 11/1992 | Windley |
| 5,242,633 | A | 9/1993 | Rook et al. |
| 5,326,241 | A | 7/1994 | Rook et al. |
| 5,344,297 | A | 9/1994 | Hills |
| 5,419,794 | A | 5/1995 | Hauber et al. |
| 5,441,754 | A | 8/1995 | Evans, Sr. |
| 5,447,423 | A | 9/1995 | Fuisz et al. |
| 5,458,823 | A | 10/1995 | Perkins et al. |
| 5,460,498 | A | 10/1995 | Steel et al. |
| 5,480,598 | A | 1/1996 | Gentile et al. |
| 5,556,589 | A | 9/1996 | Sibal |
| 5,582,841 | A | 12/1996 | Watton et al. |
| 5,622,671 | A | 4/1997 | Pellegrin et al. |
| 5,667,814 | A | 9/1997 | Shah |
| 5,698,146 | A | 12/1997 | Schippers et al. |
| 5,718,716 | A | 2/1998 | Goddard et al. |
| 5,785,996 | A | 7/1998 | Snyder |
| 5,911,942 | A | 6/1999 | Fofonoff et al. |
| 5,939,120 | A | 8/1999 | Bogue et al. |
| 6,110,590 | A | 8/2000 | Zarkoob et al. |
| 6,159,597 | A | 12/2000 | Meerman et al. |
| 6,216,430 | B1 | 4/2001 | Oppermann |
| 6,221,487 | B1 | 4/2001 | Luo et al. |
| 6,235,392 | B1 | 5/2001 | Luo et al. |
| 6,382,526 | B1 | 5/2002 | Reneker et al. |
| 6,511,930 | B1 | 1/2003 | Luo et al. |
| 6,524,514 | B1 | 2/2003 | Volokitin et al. |
| 6,548,166 | B2 | 4/2003 | Soroka et al. |
| 6,596,033 | B1 | 7/2003 | Luo et al. |
| 6,682,677 | B2 | 1/2004 | Lobovsky et al. |
| 6,713,011 | B2 | 3/2004 | Chu et al. |
| 6,753,454 | B1 | 6/2004 | Smith et al. |
| 6,783,708 | B2 | 8/2004 | Konishi |
| 6,787,090 | B2 | 9/2004 | Dalton et al. |
| 6,843,902 | B1 | 1/2005 | Penner et al. |
| 6,852,410 | B2 | 2/2005 | Veedu et al. |
| 6,858,168 | B1 | 2/2005 | Vollrath et al. |
| 6,872,311 | B2 | 3/2005 | Koslow |
| 6,904,745 | B2 | 6/2005 | Badiali et al. |
| 7,018,188 | B2 | 3/2006 | James et al. |
| 7,032,664 | B2 | 4/2006 | Lord et al. |
| 7,036,592 | B2 | 5/2006 | Nguyen et al. |
| 7,056,455 | B2 | 6/2006 | Matyjaszewski et al. |
| 7,056,849 | B2 | 6/2006 | Wan et al. |
| 7,067,444 | B2 | 6/2006 | Luo et al. |
| 7,118,698 | B2 | 10/2006 | Armantrout et al. |
| 7,127,294 | B1 | 10/2006 | Wang et al. |
| 7,134,857 | B2 * | 11/2006 | Andrady et al. ..... 425/66 |
| 7,146,792 | B2 | 12/2006 | Badiali et al. |
| 7,169,374 | B2 | 1/2007 | Siochi et al. |
| 7,186,474 | B2 | 3/2007 | Jang |
| 7,208,546 | B2 | 4/2007 | Rajagopalan et al. |
| 7,288,306 | B2 | 10/2007 | Kersey |
| 7,316,723 | B2 | 1/2008 | Chung et al. |
| 7,332,050 | B2 | 2/2008 | Kim |
| 7,655,175 | B2 | 2/2010 | Michael et al. |
| 7,691,168 | B2 | 4/2010 | Fox et al. |
| 7,763,228 | B2 | 7/2010 | Oya et al. |
| 7,857,608 | B2 | 12/2010 | Fabbricante et al. |
| 7,901,195 | B2 | 3/2011 | Fabbricante et al. |
| 7,931,456 | B2 | 4/2011 | Bryner et al. |
| 8,110,136 | B2 | 2/2012 | Takahashi et al. |
| 8,163,227 | B2 | 4/2012 | Sumida et al. |
| 8,277,711 | B2 | 10/2012 | Huang et al. |
| 8,303,874 | B2 | 11/2012 | Marshall et al. |
| 2002/0106509 | A1 | 8/2002 | Figuly et al. |
| 2004/0076661 | A1 | 4/2004 | Chu et al. |
| 2004/0096533 | A1 | 5/2004 | Dubson et al. |
| 2005/0054830 | A1 | 3/2005 | Islam et al. |
| 2005/0081506 | A1 | 4/2005 | Badiali et al. |
| 2005/0136253 | A1 | 6/2005 | Michael et al. |
| 2005/0163955 | A1 | 7/2005 | Schaefer et al. |
| 2006/0024399 | A1 | 2/2006 | Chang et al. |
| 2006/0048355 | A1 | 3/2006 | Kim |
| 2006/0049542 | A1 | 3/2006 | Chu et al. |
| 2006/0091582 | A1 | 5/2006 | James et al. |
| 2006/0228435 | A1 | 10/2006 | Andrady et al. |
| 2007/0023958 | A1 | 2/2007 | LaVietes et al. |
| 2007/0057414 | A1 | 3/2007 | Hartge |
| 2007/0184079 | A1 | 8/2007 | Gabbay |
| 2008/0023888 | A1 | 1/2008 | Brang et al. |
| 2008/0029617 | A1 | 2/2008 | Marshall et al. |
| 2008/0050304 | A1 | 2/2008 | Oya et al. |
| 2008/0136054 | A1 | 6/2008 | Fabbricante et al. |
| 2008/0211121 | A1 * | 9/2008 | Lai et al. ..... 264/8 |
| 2008/0242171 | A1 | 10/2008 | Huang et al. |
| 2009/0020921 | A1 | 1/2009 | Cakmak et al. |
| 2009/0042475 | A1 | 2/2009 | Pourdeyhimi |
| 2009/0102100 | A1 | 4/2009 | Hellring et al. |
| 2009/0155326 | A1 | 6/2009 | Mack et al. |
| 2009/0160099 | A1 | 6/2009 | Huang |
| 2009/0162468 | A1 | 6/2009 | Barinov et al. |
| 2009/0232920 | A1 | 9/2009 | Lozano et al. |
| 2009/0269429 | A1 | 10/2009 | Lozano et al. |
| 2009/0280207 | A1 | 11/2009 | Lozano et al. |
| 2009/0280325 | A1 | 11/2009 | Lozano et al. |
| 2010/0233115 | A1 | 9/2010 | Patel et al. |
| 2010/0285291 | A1 | 11/2010 | Reibel et al. |

FOREIGN PATENT DOCUMENTS

| | | |
|---|---|---|
| EP | 0003908 | 9/1979 |
| EP | 0306033 | 3/1989 |
| EP | 0709035 | 5/1996 |
| EP | 1673493 | 7/2009 |
| JP | 2001073222 | 3/2001 |
| JP | 2009270221 | 11/2009 |
| KR | 20040052685 | 6/2004 |
| WO | 03042436 | 5/2003 |
| WO | 2004056716 | 7/2004 |
| WO | 2005042813 | 5/2005 |
| WO | 2009079523 | 6/2006 |
| WO | 2008077349 | 7/2008 |
| WO | 2008121338 | 10/2008 |
| WO | 2013/096672 | 6/2013 |

OTHER PUBLICATIONS

Champion et al. "Making Micro—and Nanoparticles of Complex Shapes" PNAS, 104:11901-11904, 2007.

"Cotton Candy Express." Available at http://cottoncandyexpress.com/resimachine, Jun. 8, 2009.

Dauner "Centrifuge Spinning—An Economic Alternative to Electrospinning" Nano-Cluster Bodensee, NanoEurope 2006, Sep. 14, 2006.

Foster et al. "Centrifugally Spun Polyhydroxybutyrate Fibres: Accelerated Hydrolytic Degredation Studies" Polymer Degradation and Stability, 87(1), 2005, 1-10.

Greensfelder "Nanofibers Created in Orderly Fashion"UC Berkeley Press Release, Jun. 1, 2009.

"Manufacturing: Synthetic and Cellulosic Fiber Formation Technology", Fibersource.com, Aug. 23, 2007.

Mellado et al. "A simple model for nanofiber formation by rotary jet-spinning" Applied Physics Letters 99, 203107 (2011).

"Nonwovens Interactive", Jun. 8, 2009.

Patel et al. "Novel Preparation Method of Silicon Carbide Nanofibers by Use of Polymer Blend and Melt Spinning Techniques" Journal of Ceramic Society of Japan, 112:S901-S903, 2004.

Quintero et al. "Rapid Production of Ultralong Amorphous Ceramic Nanofibers by Laser Spinning" App. Physics Let, 90:153109, 2007.

Rodriguez et al. "Preparation of Electrospun Chitosa-PEO Fibers" Bioengineering Conference, 2006, Proceedings of the IEEE 32nd Annual Northeast, 87-88, Apr. 2006.

Teo et al. "A Review on Electrospinning Design and Nanofiber Assemblies" Nanotechnology, 17:R89-R106, 2006.

Warner et al. "Cost Effective Nanofiber Formation: Melt Electrospinning" National Textile Center Annual Report, Nov. 2005.

Weitz et al. "Polymer Nanofibers Via Nozzle-Free Centrifugal Spinning" Nano Letters, 8:1187-1191, 2008.

(56) References Cited

OTHER PUBLICATIONS

International Search Report and Written Opinion for PCT Application No. PCT/US2009/037275, Issued Jul. 8, 2009.
International Preliminary Report on Patentability for PCT Application No. PCT/US2009/037275, Issued Jul. 8, 2009.
International Search Report and Written Opinion for PCT Application No. PCT/US2009/037284, Issued May 12, 2009.
International Preliminary Report on Patentability for PCT Application No. PCT/US2009/037284, Issued May 12, 2009.
International Search Report and Written Opinion for PCT Application No. PCT/US2009/037288, Issued May 18, 2009.
International Preliminary Report on Patentability for PCT Application No. PCT/US2009/037288, Issued May 18, 2009.
International Search Report and Written Opinion for PCT Application No. PCTUS2012028503 issued Oct. 23, 2012.
International Search Report and Written Opinion for PCT Application No. PCTUS2012024109 issued Sep. 26, 2012.
International Search Report and Written Opinion for PCT Application No. PCTUS2012024154 issued Feb. 7, 2012.
International Search Report and Written Opinion for PCT Application No. PCTUS2012024103 issued Sep. 26, 2012.
International Search Report and Written Opinion for PCT Application No. PCTUS2012024142 issued Jan. 2, 2013.
International Search Report and Written Opinion for PCT Application No. PCTUS2012024145 issued Sep. 27, 2012.
Supplemental European Search Report for EP2257660 issued Nov. 25, 2011.
Supplemental European Search Report for EP2268467 issued Nov. 25, 2011.
Supplemental European Search Report for EP2271796 issued Nov. 28, 2011.
Supplemental European Search Report for EP2265752 issued Nov. 25, 2011.
Office Action for U.S. Appl. No. 12/404,907 issued Jan. 11, 2013.

* cited by examiner (TOP VIEW)

(SIDE VIEW)

(TOP VIEW)

(SIDE VIEW)

(TOP VIEW)

(SIDE VIEW)

SUPERFINE FIBER CREATING SPINNERET AND USES THEREOF

RELATED APPLICATIONS

This application is a continuation of U.S. patent application Ser. No. 12/404,948 entitled "SUPERFINE FIBER CREATING SPINNERET AND USES THEREOF" filed on Mar. 16, 2009, now U.S. Pat. No. 8,231,378, which claims the benefit of: U.S. Provisional Patent Application No. 61/037,184, filed Mar. 17, 2008; U.S. Provisional Patent Application No. 61/037,193, filed Mar. 17, 2008; U.S. Provisional Patent Application No. 61/037,209, filed Mar. 17, 2008; and U.S. Provisional Patent Application No. 61/037,216, filed Mar. 17, 2008; all of which are hereby incorporated by reference in their entireties.

BACKGROUND OF THE INVENTION

1. Field of the Invention

The present invention generally relates to the field of fiber production, such as superfine fibers of micron and sub-micron size diameters as well as nanofibers. Superfine fibers may be made of a variety of materials.

2. Description of Related Art

Fibers having small diameters (e.g., micrometer ("micron") to nanometer ("nano")) are useful in a variety of fields from clothing industry to military applications. For example, in the biomedical field, there is a strong interest in developing structures based on nanofibers that provide a scaffolding for tissue growth to effectively support living cells. In the textile field, there is a strong interest in nanofibers because the nanofibers have a high surface area per unit mass that provide light but highly wear-resistant garments. As a class, carbon nanofibers are being used, for example, in reinforced composites, in heat management, and in reinforcement of elastomers. Many potential applications for small-diameter fibers are being developed as the ability to manufacture and control their chemical and physical properties improves.

It is well known in fiber manufacturing to produce extremely fine fibrous materials of organic fibers, such as described in U.S. Pat. Nos. 4,043,331 and 4,044,404, where a fibrillar mat product is prepared by electrostatically spinning an organic material and subsequently collecting spun fibers on a suitable surface; U.S. Pat. No. 4,266,918, where a controlled pressure is applied to a molten polymer which is emitted through an opening of an energy charged plate; and U.S. Pat. No. 4,323,525, where a water soluble polymer is fed by a series of spaced syringes into an electric field including an energy charged metal mandrel having a sheath of aluminum foil wrapper therearound which may be coated with a PTFE (Teflon™) release agent. Attention is further directed to U.S. Pat. Nos. 4,044,404, 4,639,390, 4,657,743, 4,842,505, 5,522,879, 6,106,913 and 6,111,590—all of which feature polymer nanofiber production arrangements.

Electrospinning is a major manufacturing method to make nanofibers. Examples of methods and machinery used for electrospinning can be found, for example, in the following U.S. Pat. Nos. 6,616,435; 6,713,011; 7,083,854; and 7,134,857.

SUMMARY OF THE INVENTION

The present invention is directed to apparatuses and methods of creating fibers, such as superfine fibers, which include fibers having diameters ranging from micron to nano in size (e.g., micrometer(s), nanometer(s)). The methods discussed herein employ centrifugal forces to transform material into superfine fibers. Apparatuses that may be used to create superfine fibers are also described.

The methods discussed herein may be adapted to create, for example, nanocomposites and functionally graded materials that can be used for fields as diverse as, for example, drug delivery and ultrafiltration (such as electrets). Metallic and ceramic nanofibers, for example, may be manufactured by controlling various parameters, such as material selection and temperature. At a minimum, the methods and apparatuses discussed herein may find application in any industry that utilizes micro- to nano-sized fibers and/or micro- to nano-sized composites. Such industries include, but are not limited to, the food, drug, materials, mechanical, electrical, defense, and/or tissue engineering industries.

Some embodiments of the present apparatuses may be used for both melt and solution processes. Some embodiments of the present apparatuses may be used for making both organic or inorganic fibers as well. With appropriate manipulation of the environment and process, it is possible with some embodiments of the present apparatuses to form superfine fibers of various configurations, such as continuous, discontinuous, mat, random fibers, unidirectional fibers, woven and unwoven, as well as fiber shapes, such as circular, elliptical and rectangular (e.g., ribbon). Other shapes are also possible. The superfine fiber may be lumen or multi-lumen.

By controlling the process parameters of some embodiments of the present methods, fibers can be made in micron, sub-micron and nano-sizes, and combinations thereof. In general, the superfine fibers created will have a relatively narrow distribution of fiber diameters. Some variation in diameter and cross-sectional configuration may occur along the length of individual superfine fibers and between superfine fibers.

Because of the variety of properties that may be imparted to the superfine fibers created using some embodiments of the present apparatuses, such apparatuses may be termed "multi-level variable fiber spinners." More generally, the present invention concerns multi-level superfine fiber creation, in certain embodiments.

Accordingly, one general aspect of the present methods discussed herein includes a method of creating superfine fibers, such as nanofibers, comprising: heating a material; placing the material in a heated structure; and after the placing, rotating the heated structure at a rate of at least 500 revolutions per minute (RPM) to create the nanofibers from the material. In some embodiments of the present methods, the superfine fibers may be micron fibers, sub-micron fibers, or nanofibers, A "heated structure" is defined as a structure that has a temperature that is greater than the ambient temperature. "Heating a material" is defined as raising the temperature of that material to a temperature above ambient temperature. In alternate embodiments, the structure is not heated. Indeed, for any embodiment that employs a heated structure, a structure that is not heated may alternatively be employed. In some embodiments, the material is not heated. It is also to be understood that for any embodiments that employs heating a material or a heated material, material that is not heated may alternatively be employed. In some embodiments, the structure is heated but the material is not heated. In some embodiments, the structure is heated and the material is not heated, such that the material becomes heated once placed in contact with the heated structure. In some embodiments, the material is heated and the structure is not heated, such that the structure becomes heated once it comes into contact with the heated material.

As noted, the heated structure may be rotated. The heated structure may also be spun about a spin axis. The heated structure may be rotated at, for example, 500-25,000 revolutions per minute (RPM), in certain embodiments, or any range derivable therein. In certain embodiments, the heated structure is rotated at no more than 50,000, 45,000, 40,000, 35,000, 30,000, 25,000, 20,000, 15,000, 10,000, 5,000, or 1,000 RPM. In certain embodiments, the heated structure is rotated at no more than 40,000 RPM. In certain embodiments, the heated structure is rotated at a rate of 5,000-25,000 RPM.

A wide range of volumes/amounts of material may be used in embodiments of the present methods. In addition, a wide range of rotation times may also be employed. For example, in certain embodiments, at least 5 milliliters (mL) of material are positioned in a heated structure, and the heated structure is rotated for at least 10 seconds. As discussed above, the rotation may be at a rate of 500-25,000 RPM, for example. The amount of material may range from mL to liters (L), or any range derivable therein. For example, in certain embodiments, at least 50-100 mL of the material are positioned in the heated structure, and the heated structure is rotated at a rate of 500-25,000 RPM for 300-2,000 seconds. In certain embodiments, at least 5-100 mL of the material are positioned in the heated structure, and the heated structure is rotated at a rate of 500-25,000 RPM for 10-500 seconds. In certain embodiments, at least 100-1,000 mL of the material are positioned in the heated structure, and the heated structure is rotated at a rate of 500-25,000 RPM for 100-5,000 seconds. Other combinations of amounts of material, RPMs and seconds are contemplated as well.

In certain embodiments, the heated structure includes at least one opening and the material is extruded through the opening to create the nanofibers. In certain embodiments, the heated structure includes multiple openings and the material is extruded through the multiple openings to create the nanofibers. These openings may be of a variety of shapes (e.g., circular, elliptical, rectangular, square) and of a variety of diameter sizes (e.g., 0.01-0.80 mm). When multiple openings are employed, not every opening need be identical to another opening, but in certain embodiments, every opening is of the same configuration.

The material may, in certain embodiments, be positioned in a reservoir of the heated structure. The reservoir may, for example, be defined by a concave cavity of the heated structure. In certain embodiments, the heated structure includes at least one opening in communication with the concave cavity, the nanofiber is extruded through the opening, the heated structure is rotated about a spin axis, and the opening has an opening axis that is not parallel with the spin axis. The heated structure may include multiple openings in communication with the concave cavity. These openings are similar to those openings described above. Furthermore, the heated structure may include a body that includes the concave cavity and a lid positioned above the body such that a gap exists between the lid and the body, and the nanofiber is created as a result of the rotated material exiting the concave cavity through the gap.

In particular embodiments, the heated structure is thermally coupled to a heat source that can be used to adjust the temperature of the heated structure before operation (e.g., before rotating). Heat sources that may be employed are described below. A wide variety of temperatures may be achieved, and in certain embodiments, the heated structure is heated to a temperature less than 1500° C. before operation. The heated structure may be heated to temperatures greater than 1500° C. before operation as well, such as to 2500° C. In certain embodiments, the heated structure is heated to a temperature less than 400° C. before operation. In certain embodiments, the heated structure is heated to a temperature that ranges between one degree Celsius above ambient temperature and 400° C. before operation. In particular embodiments, the heated structure is thermally coupled to a heat source and/or a cooling source that can be used to adjust the temperature of the heated structure before operation, a cooling source that can be used to adjust the temperature of the heated structure before operation, or both a heat source that can be used to adjust the temperature of the heated structure during the spinning and a cooling source that can be used to adjust the temperature of the heated structure before operation. Cooling sources are described below.

In any method described herein, the method may comprise adjusting the temperature of the heated structure during operation (e.g., during rotating). In certain embodiments, the heated structure is maintained at a temperature of not more than 1500° C. during operation. The heated structure may be maintained at temperatures higher than 1500° C. during operation as well, such as 2500° C. In certain embodiments, the heated structure is adjusted to a temperature of not more than 400° C. during operation. In certain embodiments, the heated structure is heated to a temperature that ranges between one degree Celsius above ambient temperature and 400° C. during operation. In particular embodiments, the heated structure is thermally coupled to a heat source and/or a cooling source that can be used to adjust the temperature of the heated structure during operation, a cooling source that can be used to adjust the temperature of the heated structure during operation, or both a heat source that can be used to adjust the temperature of the heated structure during operation and a cooling source that can be used to adjust the temperature of the heated structure during operation. The heated structure may be cooled to temperatures as low as, for example, −20° C. An exemplary range of temperatures for any heated structure described herein is −20° C. to 2500° C.

The heated structure may take on a variety of configurations. For example, the heated structure may comprise a syringe and a plunger. Any syringe equipped with a plunger as known to those of skill in the art may be used. The material may be placed in the syringe. Moreover, instead of a plunger, another object may be used that prevents unwanted leakage of the material from the syringe. In certain embodiments, the syringe further comprises a needle that is attached to the syringe. The gauge (G) of the needle may range from, for example, 16 G (1.194 mm) to 25 G (0.241 mm). In certain embodiments, the syringe and plunger are rotated at a rate of 500-25,000 RPM, or any range derivable therein. In certain embodiments, at least 10-500 mL of the material are positioned in the syringe, and the syringe and plunger are rotated at a rate of 500-25,000 RPM for 10-1,000 seconds. In particular embodiments, a syringe support device supports the syringe. The syringe support device may, for example, comprise an elongated structure with open ends and an open top.

Any method described herein may further comprise collecting at least some of the nanofibers that are created. As used herein "collecting" of superfine fibers, such as nanofibers, refers to superfine fibers coming to rest against a superfine fiber collection device, as described herein, as well as removal of superfine fibers, such as from a superfine fiber collection device, such as removal by a human or robot. A variety of methods and superfine fiber (e.g., nanofiber) collection devices may be used to collect superfine fibers. For example, regarding nanofibers, a collection wall may be employed that collects at least some of the nanofibers in certain embodiments, a collection rod collects at least some of the nanofibers. The collection rod may be stationary during collection, or the collection rod may be rotated during collection. For example, the collection rod may be rotated at 50-250 RPM, in certain embodiments. In certain embodiments, an elongated structure with open ends and an open top collects at least some of the nanofibers. As noted above, a syringe support device may comprise an elongated structure with open ends and an open top. In certain embodiments, a syringe support device also collects superfine fibers, such as nanofibers.

Regarding the nanofibers that are collected, in certain embodiments, at least some of the nanofibers that are collected are in a configuration selected from the group consisting of continuous, discontinuous, mat, woven and unwoven. In particular embodiments, the nanofibers are not bundled into a cone shape after their creation. In particular embodiments, the nanofibers are not bundled into a cone shape during their creation. In particular embodiments, nanofibers are not shaped into a particular configuration, such as a cone figuration, using air, such as ambient air, that is blown onto the nanofibers as they are created and/or after they are created.

Present methods may further comprise, for example, introducing a gas through an inlet in a housing, where the housing surrounds at least the heated structure. The gas may be, for example, nitrogen, helium, argon, or oxygen. A mixture of gases may be employed, in certain embodiments.

The environment in which the nanofibers are created may comprise a variety of conditions. For example, any nano fiber discussed herein may be created in a sterile environment. As used herein, the term "sterile environment" refers to an environment where greater than 99% of living germs and/or microorganisms have been removed. In certain embodiments, "sterile environment" refers to an environment substantially free of living germs and/or microorganisms. The nanofiber may be created, for example, in a low-pressure environment, such as an environment of 1-760 millimeters (mm) of mercury (Hg) of pressure, or any range derivable therein. In certain embodiments, the nanofiber is created in a high-pressure environment, such as an environment of 761 mm Hg to 4 atmospheres (atm) of pressure, or any range derivable therein. Higher pressures are also possible. In certain embodiments, the nanofiber is created in an environment of 0-100% humidity, or any range derivable therein. The temperature of the environment in which the nanofiber is created may vary widely. In certain embodiments, the temperature of the environment in which the nanofiber is created can be adjusted before operation (e.g., before rotating) using a heat source, a cooling source, or both a heating source and a cooling source. Moreover, the temperature of the environment in which the nanofiber is created can be adjusted during operation using a heat source, a cooling source, or both a heating source and a cooling source. The temperature of the environment may be as low as sub-freezing, such as −20° C., or lower. The temperature of the environment may be as high as, for example, 1500° C. Higher temperatures are also employed, in certain embodiments.

The material employed in the present methods may comprise one or more ingredients and may be of a single phase (e.g., solid) or a mixture of phases (e.g., solid particles in a liquid), before or after the material is heated. The material may be a fluid. In certain embodiments, the material comprises a solid before it is heated. In certain embodiments, the material comprises a liquid before it is heated. The material may comprise a solvent (e.g., water, de-ionized water, dimethylsulfoxide), a solute (e.g., polymer pellets, drugs, other chemicals), an additive (e.g., thinner, surfactant, plasticizer), or any combination thereof. The material may comprise a liquid after it is heated. The material may comprise at least one polymer. The polymer may comprise, for example, polypropylene, polystyrene, acrylonitrile butadiene styrene, nylon, polycarbonate, or any combination thereof. The polymer may be a synthetic (man-made) polymer or a natural polymer. The material may comprise, for example, at least one metal. Metals employed in fiber creation are well-known to those of skill in the art. In certain embodiments, the metal may be selected from the group consisting of bismuth, tin, zinc, silver, gold, nickel and aluminum. The material may comprise, for example, at least one ceramic, such as alumina, titania, silica, or zirconia, or combinations thereof. The material may comprise a composite, for example, such as bronze, brass, or a drug combined with a carrier polymer (e.g., agarose).

The nanofiber that is created may be, for example, one micron or longer in length. For example, created nanofibers may be of lengths that range from 1-9 micrometers to 1-9 millimeters to 1-9 centimeters, or longer. When continuous methods are performed, nanofibers of up to and over 1 meter in length may be made. In certain embodiments, the cross-section of the nanofiber is a shape selected from the group consisting of circular, elliptical and rectangular. Other shapes are also possible. The nanofiber may be lumen or multi-lumen. As with the materials described above, the nanofiber may comprise at least one polymer. The polymer may comprise, for example, polypropylene, polystyrene, acrylonitrile butadiene styrene, nylon, beta-lactam, agarose, albumin, or polycarbonate, or any combination thereof. The nanofiber may comprise at least one metal. Metals employed in fibers are well-known to those of skill in the art. The metal may, for example, be selected from the group consisting of bismuth, tin, zinc, silver, gold, nickel and aluminum. The nanofiber may, for example, comprise at least one ceramic, for example. The ceramic may be alumina, titania, silica, or zirconia, or combinations thereof, for example. The nanofiber may comprise at least one composite. The composite may be bronze, brass, or a drug combined with a carrier polymer (e.g., agarose), for example. The composite may be a carbon nanotube reinforced polymer composite. In particular embodiments, the nanofiber comprises at least two of the following: a polymer, a metal, a ceramic, a drug, and/or a composite.

The nanofiber created by the methods described herein may be a beta-lactam nanofiber. The nanofiber may be a polypropylene nanofiber. The nanofiber may be acrylonitrile butadiene styrene nano fiber.

In particular embodiments, the heated structure employed in the methods and apparatuses described herein is further defined as a spinneret. Alternatively, a cooled structure may be further defined as a spinneret. As used herein, a spinneret is (a) an object that may hold the material described herein and that may be spun (e.g., at 500-25,000 RPM), where the material may exit the spinneret via at least one pathway, or (b) a collection of objects, where at least one of the collection of objects may hold the material described herein, where the collection of objects may be spun together (e.g., at 500-25,000 RPM) and the material may exit the spinneret via at least one pathway.

Another general aspect of the present methods discussed herein includes a method of creating superfine fibers, such as nanofibers, comprising: heating a material; placing the material in a cooled structure; and after the placing, rotating the cooled structure at a rate of at least 500 revolutions per minute (RPM) to create the nanofibers from the material. The material need not be heated prior to its placement in the cooled structure, in some embodiments. Thus, the material may be at an ambient temperature, or may be cooled (that is, an embodiment may comprise "cooling a material"). A "cooled structure" is defined as a structure that has a temperature that is less than the ambient temperature. "Cooling a material" is defined as lowering the temperature of that material to a temperature below ambient temperature. It is also to be understood that for any embodiments that employs cooling a material or a cooled material, material that is not cooled may alternatively be employed. In some embodiments, the structure is cooled but the material is not cooled. In some embodiments, the structure is cooled and the material is not cooled, such that the material becomes cooled once placed in contact with the cooled structure. In some embodiments, the material is cooled and the structure is not cooled, such that the structure becomes cooled once it comes into contact with the cooled material. For any embodiment described herein employing a heated structure, a cooled structure may alternatively be employed, in some embodiments. A cooled structure and/or a cooled material may be cooled to as low as, for example, −20° C., in some embodiments.

Another general aspect of the present methods discussed herein includes a method of creating a superfine fiber, comprising: spinning material to create the superfine fiber; where, as the superfine fiber is being created, the superfine fiber is not subjected to an externally-applied electric field or an externally-applied gas; and the superfine fiber does not fall into a liquid after being created. As used herein, a "superfine fiber" is a fiber whose diameter ranges from micron (typically single digit) to sub-micron (e.g., between micron and nanometer, such as 700 to 900 nanometers) to nano (typically 100 nanometers or less). In such methods, the material may be spun at, for example, 500-25,000 RPM, or any range derivable therein. In certain embodiments, the material is spun at no more than 50,000, 45,000, 40,000, 35,000, 30,000, 25,000, 20,000, 15,000, 10,000, 5,000, or 1,000 RPM. In certain embodiments, the material is spun at no more than 40,000 RPM. In certain embodiments, the material is spun at a rate of 5,000-25,000 RPM.

In particular embodiments, a superfine fiber of the present fibers is not a lyocell fiber. Lyocell fibers are described in the literature, such as in U.S. Pat. Nos. 6,221,487, 6,235,392, 6,511,930, 6,596,033 and 7,067,444, each of which is incorporated herein by reference.

In certain methods of creating a superfine fiber as described herein, the spinning may comprise spinning material to form multiple superfine fibers, and where: none of the superfine fibers that are created is subjected to an externally-applied electric field or an externally-applied gas during the creation, and none of the superfine fibers falls into a liquid after being created. In certain embodiments, the material is spun at no more than 50,000, 45,000, 40,000, 35,000, 30,000, 25,000, 20,000, 15,000, 10,000, 5,000, or 1,000 RPM. In certain embodiments, the material is spun at no more than 40,000 RPM. The material may be spun, for example, at a rate of 5,000-25,000 RPM.

In certain methods of creating a superfine fiber, at least 5 mL of the material may be spun at a rate of 500-25,000 RPM for at least 10 seconds. Indeed, a wide range of volumes/amounts of material may be used in the methods of creating a superfine fiber, as discussed herein. The amount of material may range from mL to liters, or any range derivable therein. A wide range of volumes/amounts of material may be used in the methods discussed herein. For example, in certain embodiments, at least 50-100 mL of the material are spun at a rate of 500-25,000 RPM for 300-2,000 seconds. In certain embodiments, at least 5-100 mL of the material are spun at a rate of 500-25,000 RPM for 10-500 seconds. In certain embodiments, at least 100-1,000 mL of the material are spun at a rate of 500-25,000 RPM for 100-5,000 seconds. Other combinations of amounts of material, RPMs and seconds are contemplated as well.

In certain methods of creating a superfine fiber as described herein, the material is housed in a spinneret, and the spinneret is spun during the spinning. The spinneret may, for example, include at least one opening and the material is extruded through the opening to create at least some of the superfine fibers. In certain embodiments, the spinneret includes multiple openings and the material is extruded through the multiple openings to create at least some of the superfine fibers. The openings in the spinneret may have the same properties as the openings described above and throughout this application.

In certain methods that employ a spinneret, at least 50-100 mL of the material are spun at a rate of 500-25,000 RPM for 300-2,000 seconds. In certain embodiments, at least 5-100 mL of the material are spun at a rate of 500-25,000 RPM for 10-500 seconds. Indeed, a variety of amounts of material, RPMs and seconds may be employed in these methods, similar to the methods described above.

In certain embodiments, the material is positioned in a reservoir of the spinneret. In such methods, at least 100-1,000 mL of the material are spun at a rate of 500-25,000 RPM for 100-5,000 seconds, in certain embodiments. Ranges of volumes of material are not limited to this range, but may be less than 100 mL and may be greater than one liter. Varying rotation speeds are also contemplated, as are lengths of time the material is rotated. In certain embodiments, the reservoir is defined by a concave cavity of the spinneret. In particular embodiments, the spinneret includes at least one opening in communication with the concave cavity, the superfine fiber is extruded through the opening, the spinneret is spun about a spin axis, and the opening has an opening axis that is not parallel with the spin axis. With respect to such an embodiment, the spinneret may further include multiple openings in communication with the concave cavity. The spinneret may include a body that includes the concave cavity and a lid positioned above the body such that a gap exists between the lid and the body, and the superfine fiber is created as a result of the spun material exiting the concave cavity through the gap.

In certain embodiments, a spinneret of the present spinnerets may comprise a syringe and a plunger. Any syringe equipped with a plunger as known to those of skill in the art may be used. The material may be placed in the syringe. The syringe and the plunger may be spun at a rate of 500-25,000 RPM, or any range derivable therein. Moreover, instead of a plunger, another object may be used that prevents unwanted leakage of the material from the syringe. In certain embodiments, the syringe further comprises a needle that is attached to the syringe. The gauge of the needle may range from, for example, 16 G (1.194 mm) to 25 G (0.241 mm). In certain embodiments, at least 10-500 mLs of the material are positioned in the syringe, and the syringe and plunger are rotated at a rate of 500-25,000 RPM for 10-1,000 seconds. In particular embodiments, a syringe support device supports the syringe. The syringe support device may, for example, comprise an elongated structure with open ends and an open top.

In certain methods that employ a spinneret, such methods may comprise adjusting the temperature of the spinneret before the spinning. For example, the spinneret may be adjusted to a temperature of between −20° C. and 1500° C. before the spinning. Temperatures below −20° C. and above 1500° C. are also contemplated, such as 2500° C. In certain embodiments, the spinneret is adjusted to a temperature of between 4° C. and 400° C. before the spinning. In certain embodiments, the spinneret is thermally coupled to a heat source and/or a cooling source that can be used to adjust the temperature of the spinneret before the spinning, a cooling source that can be used to adjust the temperature of the spinneret before the spinning, or both a heat source that can be used to adjust the temperature of the spinneret before the spinning and a cooling source that can be used to adjust the temperature of the spinneret before the spinning. Heating and cooling sources are described herein. In certain embodiments, the temperature of the spinneret may be adjusted during the spinning. During spinning, the spinneret may be maintained, for example, at a temperature of between −20° C. and 1500° C., such as between 4° C. and 400° C. The temperature may be maintained below −20° C. or above 1500° C. as well, such as 2500° C. In certain embodiments, the spinneret is thermally coupled to a heat source that can be used to adjust the temperature of the spinneret during the spinning, a cooling source that can be used to adjust the temperature of the spinneret during the spinning, or both a heat source that can be used to adjust the temperature of the spinneret during the spinning and a cooling source that can be used to adjust the temperature of the spinneret during the spinning.

In embodiments that employ a spinneret, such embodiments may also comprise introducing a gas through an inlet in a housing, where the housing surrounds at least the spinneret. The gas may be, for example, nitrogen, helium, argon, or oxygen. A mixture of gases may be employed, in certain embodiments.

Certain methods contemplate collecting at least some of the superfine fibers that are created. A variety of methods and equipment pieces may be used to collect superfine fibers. For example, a collection wall may be employed that collects at least some of the superfine fibers. In certain embodiments, a collection rod collects at least some of the superfine fibers. The collection rod may be stationary during collection, or the collection rod may be rotated during collection. For example, the collection rod may be rotated at 50-250 RPM, in certain embodiments. In certain embodiments, an elongated structure with open ends and an open top collects at least some of the superfine fibers.

Regarding the superfine fibers that are collected, in certain embodiments, at least some of the superfine fibers that are collected are in a configuration selected from the group consisting of continuous, discontinuous, mat, woven and unwoven. In particular embodiments, the superfine fibers are not bundled into a cone shape during their creation. In particular embodiments, the superfine fibers are not bundled into a cone shape after their creation. In particular embodiments, superfine fibers are not shaped into a particular configuration, such as a cone figuration, using air, such as ambient air, that is blown onto the superfine fibers as they are created and/or after they are created.

The environment in which the superfine fibers are created may comprise a variety of conditions. For example, any superfine fiber discussed herein may be created in a sterile environment. The superfine fiber may be created, for example, in a low-pressure environment, such as an environment of 1-760 millimeters (mm) of mercury (Hg) of pressure, or any range derivable therein. In certain embodiments, the superfine fiber is created in a high-pressure environment, such as an environment of 761 mm Hg to 4 atmospheres (atm) of pressure, or any range derivable therein. Higher pressures are also possible. In certain embodiments, the superfine fiber is created in an environment of 0-100% humidity, or any range derivable therein. The temperature of the environment in which the superfine fibers are created may vary widely. In certain embodiments, the temperature of the environment in which the superfine fiber is created can be adjusted before the spinning using a heat source, a cooling source, or both a heating source and a cooling source. Moreover, the temperature of the environment in which the superfine fiber is created can be adjusted during the spinning using a heat source, a cooling source, or both a heating source and a cooling source. The temperature of the environment may be as low as subfreezing, such as −20° C., or lower. The temperature of the environment may, for example, be as high as 1500° C., or higher, such as 2500° C. Higher temperatures are also contemplated. The temperature of the environment in which the superfine fiber is created can be adjusted before the spinning using a heat source, a cooling source, or both a heating source and a cooling source. Moreover, the temperature of the environment in which the superfine fiber is created can be adjusted during the spinning using a heat source, a cooling source, or both a heating source and a cooling source.

In methods involving creating, or creation of, superfine fibers, the material may comprise one or more ingredients and may be of a single phase (e.g., solid) or a mixture of phases (e.g., solid particles in a liquid), before or after the material is heated. In certain embodiments, the material comprises a solid before it is heated. In certain embodiments, the material comprises a liquid before it is heated. The liquid may comprise a solvent, a solute, an additive, or any combination thereof. The material may comprise a liquid after it is heated. The material may comprise at least one polymer. The polymer may comprise, for example, polypropylene, polystyrene, acrylonitrile butadiene styrene, nylon, polycarbonate, or any combination thereof. The polymer may be a synthetic (man-made) polymer or a natural polymer. The material may comprise, for example, at least one metal. The metal may be selected from the group consisting of bismuth, tin, zinc, silver, gold, nickel and aluminum. The material may comprise, for example, at least one ceramic. For example, the ceramic may be alumina, titania, silica, or zirconia, or combinations thereof. The material may comprise a composite, for example. For example, the composite may be bronze, brass, or a drug combined with a carrier polymer (e.g., agarose). The composite may be a carbon nanotube reinforced polymer composite.

The superfine fiber that is created may be, for example, one micron or longer in length. For example, created superfine fibers may be of lengths that range from 1-9 microns to 1-9 millimeters, or longer. When continuous methods are performed, superfine fibers of up to and over 1 meter in length may be made. In certain embodiments, the cross-section of the superfine fiber is a shape selected from the group consisting of circular, elliptical and rectangular. Other shapes are also possible. The superfine fiber may be lumen or multilumen. As with the materials described above, the superfine fiber may comprise at least one polymer. The polymer may comprise, for example, polypropylene, polystyrene, acrylonitrile butadiene styrene, nylon, beta-lactam, agarose, albumin, or polycarbonate, or any combination thereof. The superfine fiber may comprise at least one metal. The metal may, for example, be selected from the group consisting of bismuth, tin, zinc, silver, gold, nickel and aluminum. The superfine fiber may, for example, comprise at least one ceramic, for example. The ceramic may be alumina, titania, silica, or zirconia, or combinations thereof, for example. The nanofiber may comprise at least one composite. The composite may be a carbon nanotube reinforced polymer composite, for example. In particular embodiments, the superfine fiber comprises at least two of the following: a polymer, a metal, a ceramic, a drug, and/or a composite.

The superfine fiber created by the methods described herein may be a microfiber. Such microfibers may, for example, comprise beta-lactam, agarose, or albumin. In certain embodiments, the superfine fiber is a sub-micron fiber.

The superfine fiber may be, for example, a nanofiber. The superfine fiber may be less than 300 nanometers in diameter, in some embodiments. The superfine fiber may be less than 100 nanometers in diameter, in some embodiments. The superfine fiber may be greater than 500 nanometers but less than ten microns in diameter, in certain embodiments. The superfine fiber may, for example, a beta-lactam nanofiber or a polypropylene nanofiber.

Other general aspects of the present methods contemplate a method of creating a superfine fiber, comprising: spinning material at a rate of 500-25,000 RPM to create the superfine fiber. For example, the rate the material is spun may be 5,000-25,000 RPM. The material may be heated before spinning. The superfine fiber may be a nanofiber, in certain embodiments.

Another general aspect of the present methods contemplates a method of creating a superfine fiber comprising: creating a superfine fiber that is one micron or longer. The superfine fiber may be a nanofiber, in certain embodiments.

A method of creating a superfine fiber comprising: creating the fiber in an environment of 761 mm Hg to 4 atm of pressure, is also contemplated. The superfine fiber may, in certain embodiments, be a nanofiber.

Furthermore, another general aspect of the present methods contemplates a method of creating a superfine fiber comprising: creating the fiber in an environment of 0-100% humidity. The superfine fiber may be a nanofiber, in certain embodiments.

Some of the present apparatuses take the form of a spinneret comprising: a plate having: a centrally-oriented reservoir; a fluid exit pathway in fluid communication with the reservoir; and a fluid exit opening in fluid communication with the fluid exit pathway; and a cover coupled to the plate; where the spinneret is configured such that, during operation, material in the reservoir flows through the fluid exit pathway and out of the spinneret through the fluid exit opening to create a superfine fiber. The plate may have, for example, multiple fluid exit pathways, each in fluid communication with the reservoir; and one fluid exit opening in fluid communication with each respective fluid exit pathway; and where the spinneret is configured such that, during operation, material in the reservoir flows through the fluid exit pathways and out of the fluid exit openings to create superfine fibers. The cover may, for example, include a fluid injection inlet through which fluid can be injected to reach the centrally-oriented reservoir. The cover may comprise a plate, and both plates of this spinneret may have substantially similar outer profiles. Moreover, such a spinneret may further comprise a holding plate to which both the plate and the cover are coupled in a stacked relationship. The spinneret may comprise, for example, metal, plastic, or both. The spinneret may be configured to withstand temperatures ranging from −20° C. to 2500° C., for example.

Other embodiments of the present spinnerets contemplate a spinneret comprising: a syringe having a plunger; and a syringe support device that includes a syringe support cavity in which at least a portion of the syringe will be positioned when the spinneret is operated, the spinneret being configured to rotate about a spin axis. The spinneret may comprise, for example, metal, plastic, or both. The spinneret may be configured to withstand temperatures ranging from −20° C. to 2500° C., for example.

Yet another embodiment of the present spinnerets contemplates a spinneret comprising: a body having a concave cavity configured to receive a molten material, the body including one or more openings in communication with the concave cavity; where the body is configured to rotate about a spin axis, each opening includes an opening axis extending through and centered in that opening, and each opening axis is oriented at an angle ranging from ±15 degrees to the spin axis. In certain embodiments, a lid may be configured to be positioned over the concave opening. Such a lid may be configured to cover and enclose the concave cavity. The concave body may be configured to receive, for example, at least 100-1,000 mL of material. This range is not restrictive, however: the concave body may be configured to receive less than 100 mL or greater than 1,000 mL, if desired. The spin axis may be centered within the concave cavity, in certain embodiments. The spinneret may comprise metal, or plastic, or both. The spinneret may be configured to withstand temperatures ranging from −20° C. to 2500° C., for example.

A further embodiment of the present spinnerets contemplates a spinneret comprising: a body having a concave cavity configured to receive a molten material; and a lid positioned above the body such that a gap exists between the lid and the body. The body and the lid may be configured to spin about a spin axis that is centered within the concave cavity. The concave body may be configured to receive, for example, at least 100-1,000 mL of material. This range is not restrictive, however: the concave body may be configured to receive less than 100 mL or greater than 1,000 mL, if desired. The spinneret may comprise metal, or plastic, or both. The spinneret may be configured to withstand temperatures ranging from −20° C. to 2500° C., for example.

Yet another embodiment of the present spinnerets contemplates a spinneret comprising a bottom plate; a top plate; and a micro-mesh material separating the bottom plate from the top plate, the spinneret being configured to rotate about a spin axis. The micro-mesh material may be, for example, stainless steel or plastic. The pore size of the micro-mesh material may range between, for example, 0.01 mm to 3.0 mm (e.g., 0.01, 0.05, 0.10, 0.20, 0.30, 0.40, 0.50, 0.75, 0.10, 0.20, 0.30, 0.40, 0.50, 0.75, 1.0, 1.5, 2.0, 2.5 or 3.0 mm or higher, or any range derivable therein). The pore sizes may be uniform throughout the mesh or may vary. The distance spanned by the micro-mesh material between the bottom plate and the top plate may range between 1-10", in certain embodiments. Both plates may, in certain embodiments, comprise substantially similar outer profiles. The spinneret may be configured to withstand temperatures ranging from −20° C. to 2500° C., for example.

When referring to "substantially similar" in the context of plates of spinnerets of the present spinnerets, it is meant that one plate's diameter is within 10% of the diameter of another.

The present invention also concerns apparatuses. For example, certain embodiments of the present apparatuses contemplate an apparatus for creating superfine fibers, comprising: a driver configured to be rotated at 500 RPM or more, a spinneret coupled to the driver; and a superfine fiber collection device; where the apparatus is configured to create superfine fibers by rotating the spinneret with the driver, and without subjecting the superfine fibers, during their creation, to either an externally-applied electric field or an externally-applied gas, and without the superfine fibers falling into liquid after being created. The superfine fiber, for example, may be a microfiber or a sub-micron fiber. The superfine fiber, for example, may be less than 300 nanometers in diameter, in certain embodiments. The superfine fiber may be a nanofiber, for example. The driver may be configured to be rotated at 500-25,000 RPM, such as 5,000-25,000 RPM. The driver may be configured to be rotated at less than 40,000 RPM, for example. The spinneret of the apparatus, in certain embodiments, comprises a concave cavity. The spinneret may further comprise a lid. The spinneret may further comprise at least one plate. For example, the spinneret may comprise at least three plates. The spinneret may comprise a syringe. Indeed, the spinneret may be any spinneret as described herein.

Apparatuses may comprise a collection device to collect the superfine (e.g., micron, sub-micron, or nano) fibers. For example, a superfine fiber collection device employed to collect such fibers may be a collection wall. The collection wall may, for example, at least partially surround the spinneret. The collection wall may completely surround the spinneret. The superfine fiber collection device may be a collection rod. The collection rod may be configured to be rotated during operation. The superfine fiber collection device may be an elongated structure with open ends and an open top. The superfine fiber collection device may also be a syringe support device.

Other features of an apparatus as described herein include, for example, a driver that comprises a motor. An apparatus may also comprise a heater thermally coupled to the spinneret. The heater may be, for example, an inductive heater, a resistance heater, an infrared heater, or a thermoelectric cooler. Other heaters are also contemplated. The apparatus may further comprise a cooler thermally coupled to the spinneret. The cooler may be, for example, a thermoelectric cooler. Other coolers are also contemplated. An apparatus may comprise an intermediate wall surrounding the superfine fiber collection device. Such an apparatus may further comprise, for example, a housing surrounding at least the spinneret, the superfine fiber collection device, and the intermediate wall, the housing including an inlet for the introduction of a gas. The housing may be insulated. One or more components of any apparatus described herein may be made of metal, plastic, stainless steel, or any combination thereof.

Any apparatus or component thereof as described herein (e.g., a spinneret) may be configured to operate in a continuous manner. Moreover, any method described herein may comprise continuous creation of superfine fibers. The term "continuous" refers to the uninterrupted operation of an apparatus or component thereof for at least 10, 15, 20, 25, 30, 35, 40, 45, 50, 55, 60 seconds or longer, or 5, 10, 20, 30, 60, 90, 120, 180, 240, 480 minutes or longer, or 0.5, 1, 2, 3, 4, 5, 6, 7, 8, 9, 10 or more days, or any range derivable therein, or the uninterrupted creation of superfine fibers for at least 10, 15, 20, 25, 30, 35, 40, 45, 50, 55, 60 seconds or longer, or 5, 10, 20, 30, 60, 90, 120, 180, 240, 480 minutes or longer, or 0.5, 1, 2, 3, 4, 5, 6, 7, 8, 9, 10 or more days, or any range derivable therein. Regarding "continuous creation of superfine fibers", this phrase is not restricted to the continuous creation of a single superfine fiber: "continuous creation of superfine fibers" also refers to the continuous creation of multiple superfine fibers over time, where new superfine fibers are continuously being created over time. In continuous operation, material may be added to a spinneret continuously, or added in batches. For any embodiment which recites a particular operation for a time range (e.g., "spinning a spinneret for 100-5,000 seconds", or "rotating a heated structure for 10-100 seconds", and the like), it is implied that operation for that time period is continuous, unless otherwise noted.

Any apparatus described herein may be configured to be operated under sterile conditions. As used herein, the term "under sterile conditions" refers to conditions where greater than 99% of living germs and/or microorganisms have been removed, such as from the components of the apparatus and the environment of the interior of the apparatus. In certain embodiments, "sterile conditions" refers to conditions substantially free of living germs and/or microorganisms.

Any apparatus described herein may be configured to be operated under pressures of 1-760 millimeters (mm) of mercury (Hg). Any apparatus described herein may be configured to be operated under pressures of 761 mm Hg to 4 atmospheres (atm).

Also contemplated by the present invention are superfine fibers, such as a superfine fiber made using a method described herein. Such a superfine fiber may be a micron-sized fiber, a sub-micron sized fiber, or a nanofiber. Superfine fibers made using the apparatuses described herein are also contemplated. Such a superfine fiber may be a micron-sized fiber, a sub-micron sized fiber, or a nanofiber.

Particular superfine fibers are also contemplated. Non-limiting examples of such superfine fibers include: a beta-lactam nanofiber, a polypropylene nanofiber, and an acrylonitrile butadiene styrene nanofiber.

In some embodiments, the superfine fibers created by the methods and devices described herein have a diameter of at least one of (and/or one selected from the group consisting of): 1-100 nanometers, 1-500 nanometers, 100-500 nanometers, 1-10 microns, 1-100 microns (micrometers), 1 nanometer-100 microns, and 1 nanometer-200 microns.

It is specifically contemplated that any limitation discussed with respect to one embodiment of the invention may apply to any other embodiment of the invention. Furthermore, any composition of the invention may be used in any method of the invention, and any method of the invention may be used to produce or to utilize any composition of the invention.

The use of the term "or" in the claims is used to mean "and/or" unless explicitly indicated to refer to alternatives only or the alternative are mutually exclusive, although the disclosure supports a definition that refers to only alternatives and "and/or."

As used herein the specification, "a" or "an" may mean one or more, unless clearly indicated otherwise. As used herein in the claim(s), when used in conjunction with the word "comprising," the words "a" or "an" may mean one or more than one. As used herein "another" may mean at least a second or more.

Any embodiment of any of the present methods and apparatus may consist of or consist essentially of—rather than comprise/include/contain/have—the described steps, elements and/or features. Thus, in any of the claims, the term "consisting of" or "consisting essentially of" may be substituted for any of the open-ended linking verbs recited above, in order to change the scope of a given claim from what it would otherwise be using the open-ended linking verb.

BRIEF DESCRIPTION OF THE FIGURES

The following figures illustrate by way of example and not limitation. Identical reference numerals do not necessarily indicate an identical structure. Rather, the same reference numeral may be used to indicate a similar feature or a feature with similar functionality. Not every feature of each embodiment is labeled in every figure in which that embodiment appears, in order to keep the figures clear.

DESCRIPTION OF ILLUSTRATIVE EMBODIMENTS

Figure 1A:
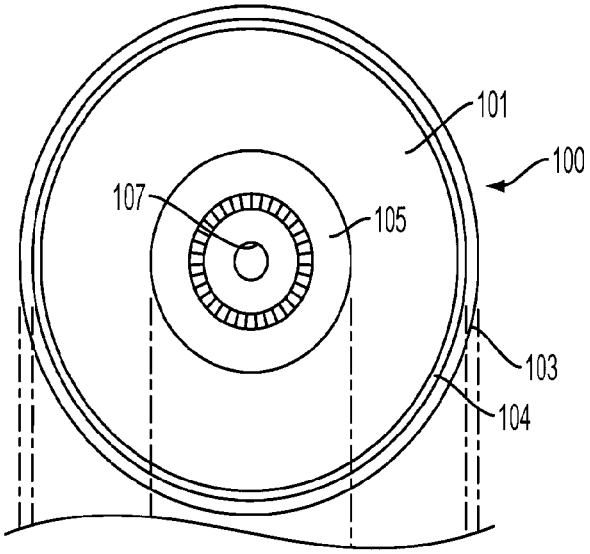
FIG. 1 depicts an embodiment of the present spinnerets that includes a single plate with multiple peripheral openings.

The term "coupled" is defined as connected, although not necessarily directly, and not necessarily mechanically. The terms "a" and "an" are defined as one or more unless this disclosure explicitly requires otherwise. The term "substantially" is defined as being largely but not necessarily wholly what is specified, as understood by a person of ordinary skill in the art. In one non-limiting embodiment, the term substantially refers to ranges within 10%, preferably within 5%, more preferably within 1%, and most preferably within 0.5% of what is specified.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a method or apparatus that "comprises," "has," "includes" or "contains" one or more steps or elements possesses those one or more steps or elements, but is not limited to possessing only those one or more steps or elements. Likewise, an element of an apparatus that "comprises," "has," "includes" or "contains" one or more features possesses those one or more features, but is not limited to possessing only those one or more features. For example, a spinneret comprising a body having a concave cavity configured to receive a molten material and a lid positioned above the body such that a gap exists between the lid and the body is a spinneret having a body that includes the specified features but is not limited to having only those features. Such a body may also include, for example, a hole, such as a threaded hole centered at the base of the spinneret that may be coupled to a joint, such as a universal threaded joint.

Furthermore, an apparatus, structure, or portion of an apparatus or structure that is configured in a certain way is configured in at least that way, but it may also be configured in ways other than those specifically described.

Embodiments of the present methods and apparatuses use centrifugal force to create superfine fibers having various sizes and properties. Embodiments of the present apparatuses and methods may be used, for example, in the biotechnology, medical device, food engineering, drug delivery, military, and/or electrical industries, or in ultra-filtration and/or micro-electric mechanical systems (MEMS).

A. Fibers

Fibers represent a class of materials that are continuous filaments or that are in discrete elongated pieces, similar to lengths of thread. Fibers are of great importance in the biology of both plants and animals, e.g., for holding tissues together. Human uses for fibers are diverse. For example, they may be spun into filaments, thread, string, or rope. They may be used as a component of composite materials. They may also be matted into sheets to make products such as paper or felt. Fibers are often used in the manufacture of other materials.

The superfine fibers discussed herein are a class of materials that exhibit a high aspect ratio (e.g., at least 100 or higher) with a minimum diameter in the range of micrometer ("micron") (typically single digit) to sub-micrometer ("sub-micron") (e.g., between micrometer and nanometer, such as 700 to 900 nanometers) to nanometer ("nano") (typically 100 nanometers or less). FIGS. 25-30 show non-limiting examples of some superfine fibers created using certain of the present methods and apparatuses. While typical cross-sections of the superfine fibers are circular or elliptic in nature, they can be formed in other shapes by controlling the shape and size of the openings in a spinneret (described below). Non-limiting examples of superfine fibers that may be created using methods and apparatuses as discussed herein include polymers (natural or synthetic (that is, man-made)), polymer blends, biomaterials (e.g., biodegradable and bioresorbable materials), metals, metallic alloys, ceramics, composites and carbon superfine fibers. Non-limiting examples of specific superfine fibers made using methods and apparatuses as discussed herein include polypropylene (PP), acrylonitrile butadiene styrene (ABS), nylon, bismuth, polyethylene oxide (PEO) and beta-lactam superfine fibers. Superfine fibers may comprise a blending of multiple materials. Superfine fibers may also include holes (e.g., lumen or multi-lumen) or pores. Multi-lumen superfine fibers may be achieved by, for example, designing one or more exit openings to possess concentric openings. In certain embodiments, such openings may comprise split openings (that is, wherein two or more openings are adjacent to each other; or, stated another way, an opening possesses one or more dividers such that two or more smaller openings are made). Such features may be utilized to attain specific physical properties, such as thermal insulation or impact absorbence (resilience). Nanotubes may also be created using methods and apparatuses discussed herein.

Superfine fibers may be analyzed via any means known to those of skill in the art. For example, Scanning Electron Microscopy (SEM) may be used to measure dimensions of a given fiber. For physical and material characterizations, techniques such as differential scanning calorimetry (DSC), thermal analysis (TA) and chromatography may be used.

B. Multi-Level Variable Fiber Spinners

The present apparatuses are configured to create superfine fibers using centrifugal force. Some embodiments of the present apparatuses may be characterized as "multi-level variable fiber spinners" or "variable fiber spinners", and comprise certain components, as described in more detail below.

1. Spinnerets

As defined above, a spinneret as used herein is (a) an object that may hold the material described herein and that may be spun (e.g., at 500-25,000 RPM), where the material may exit the spinneret via at least one pathway, or (b) a collection of objects, where at least one of the collection of objects may hold the material described herein, where the collection of objects may be spun together (e.g., at 500-25,000 RPM) and the material may exit the spinneret via at least one pathway.

Typical dimensions for non-syringe-type spinnerets are in the range of several inches (e.g., 3-8" in diameter) in diameter and 1-2" in height. For example, with respect to spinnerets that comprise one or more plates, plate diameters may range from, e.g., 3-8" in diameter. Typical values for fluid path exit opening diameters, which are often circular but not restricted to such a shape, are as follows: syringes (e.g., FIG. 4, FIG. 6) 0.01 mm to 1.0 mm; micro-mesh pores (e.g., FIG. 9) 0.01 mm to 3.0 mm (e.g., 0.05 mm to 2.0 mm); non-syringe gaps (e.g., FIG. 8) less than 1 mm to several (e.g., 3-8) mm. Lengthwise, exit openings are typically straight and typically 1-3 millimeters (e.g., FIG. 1, FIG. 2) to several (e.g., 3-8) centimeters (e.g., the needles of FIG. 4 and FIG. 6) in length. Each of these variables are flexible.

Generally speaking, a spinneret helps control various properties of the superfine fibers, such as the cross-sectional shape and diameter size of the superfine fibers. More particularly, the speed and temperature of a spinneret, as well as the cross-sectional shape, diameter size and angle of the one or more openings in a spinneret, all may help control the cross-sectional shape and diameter size of the superfine fibers. Lengths of superfine fibers produced may also be influenced by spinneret choice.

The temperature of the spinneret may influence superfine fiber properties, in certain embodiments. Both resistance and inductance heaters may be used as heat sources to heat a spinneret. In certain embodiments, the spinneret is thermally coupled to a heat source that can be used to adjust the temperature of the spinneret before the spinning, or during the spinning, or both before the spinning and during the spinning. Moreover, in certain embodiments, the spinneret is cooled. For example, the spinneret may be thermally coupled to cooling source that can be used to adjust the temperature of the spinneret before the spinning, during the spinning, or before and during the spinning. Temperatures of a spinneret may range widely. For example, a spinneret may be cooled to as low as −20° C. or heated to as high as 1500° C. Temperatures below and above these exemplary values are also possible, such as, for example, 2500° C. In certain embodiments, the temperature of a spinneret before and/or during spinning is between 4° C. and 400° C. The temperature of a spinneret may be measured by using, for example, an infrared thermometer or a thermocouple.

The speed at which a spinneret is spun may also influence superfine fiber properties. The speed of the spinneret may be fixed while the spinneret is spinning, or may be adjusted while the spinneret is spinning. Those spinnerets whose speed may be adjusted may, in certain embodiments, be characterized as "variable speed spinnerets." The RPMs of a spinneret may vary, or be varied, as low as 500 RPM (or lower) or as high as 25,000 RPM (or higher).

Another spinneret variable includes the material(s) the spinneret is made of. Spinnerets may be made of a variety of materials, including metal (brass, aluminum, stainless steel) and/or plastic. The choice of material depends on, for example, the temperature the material is to be heated to, or whether sterile conditions are desired.

Spinnerets come in a wide range of shapes and sizes, and some are commercially available. For example, spinnerets that are employed in commercially available cotton candy machines may be used, in certain embodiments. Certain embodiments of the present spinnerets are described in more detail below.

Certain spinnerets have openings through which, material is extruded during spinning. Such openings may take on a variety of shapes (e.g., circular, elliptical, rectangular, square, triangular, fanciful, or the like) and sizes: diameter sizes of 0.01-0.80 mm are typical. The angle of the opening may be varied between ±15 degrees. The openings may be threaded. An opening, such as a threaded opening, may hold a needle, where the needle may be of various shapes, lengths and gauge sizes. Threaded holes may also be used to secure a lid over a cavity in the body of a spinneret. The lid may be positioned above the body such that a gap exists between the lid and the body, and a superfine fiber is created as a result of the spun material exiting the cavity through the gap. Spinnerets may also be configured such that one spinneret may replace another within the same apparatus without the need for any adjustment in this regard. A universal threaded joint attached to various spinnerets may facilitate this replacement. Moreover, spinnerets may be configured to operate in a continuous manner.

Another type of the present spinnerets comprises a syringe that is spun. Syringes are commercially available and come in a variety of sizes. A plunger typically is used to hold material in the syringe, although other stoppers may be used for this purpose. On the end opposite of the plunger or stopper is a hole: this hole may be threaded, and a needle may be attached to this hole. A variety of needles are commercially available, including needles of various lengths and gauges. Different needles may be used with a single syringe by exchanging them. A syringe is typically secured to a syringe support device, such that the syringe and the syringe support device are spun together.

Figure 1C:
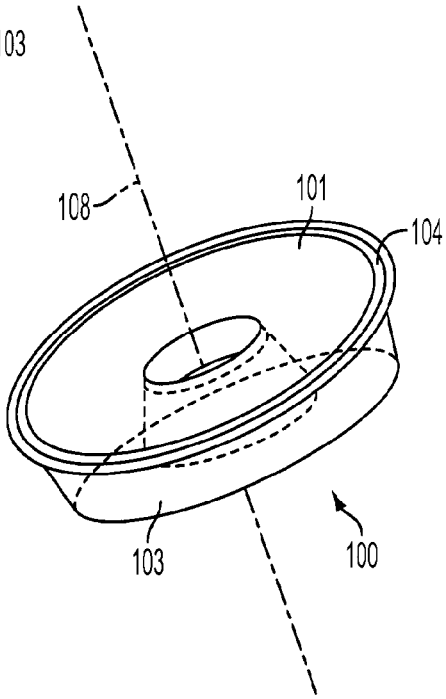
Figure 1B:
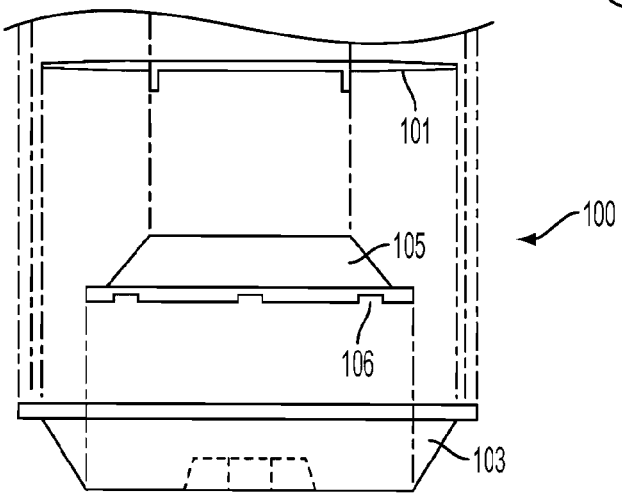

One of the present spinnerets is shown in FIG. 1. Spinneret 100 comprises a top plate 101 that is riveted (or may be otherwise coupled) to bottom plate 103. Bottom plate 103 acts as a reservoir in which material may be placed. A reservoir cover plate 105 may be put over the bottom plate 103 to control spillage and also to provide openings 106 for fluid to escape from the reservoir. Reservoir cover plate 105 has a circular opening to allow introduction of material to be spun. For this type of spinneret, typical amounts of material range from 50-100 mL, but amounts less than this may be used as well as amounts greater than this, as the size of the reservoir and the spinneret may each vary. Lining the perimeter of the reservoir is a material exit path 104: while the spinneret is spinning, material will generally follow this path. In other words, material exits openings 106 and then escapes the spinneret along 104. Material exits the spinneret through one or more openings 106. Stated otherwise, top plate 101 and/or bottom plate 103 have one or more peripheral openings 104 around the perimeter of the reservoir, as shown. In some embodiments, the one or more peripheral openings 104 comprise a plurality of peripheral openings. In some embodiments, the one or more peripheral openings 104 comprise a peripheral gap between top plate 101 and bottom plate 103, that may in some embodiments, for example, be adjusted by adjusting the distance between the top plate 101 and the bottom plate 103. In this way, as the spinneret 100 is rotated, as is described in more detail below, the material can pass through openings 106 and travel to the one or more peripheral openings 104, through which the material can exit the spinneret. The hole 107 is configured to attach to a driver, such as through a universal threaded joint. Suitable drivers include commercially available variable electric motors, such as a brushless DC motor. The spin axis 108 of this spinneret extends centrally and vertically through the hole 107, perpendicular to the top plate 101. This spinneret may be used for melt spinning or solution spinning. In certain embodiments, a spinneret of this type is spun for 300-2,000 seconds to form superfine fibers. Spinneret 100 may also be operated in a continuous mode for longer amounts of time.

Figure 2A:
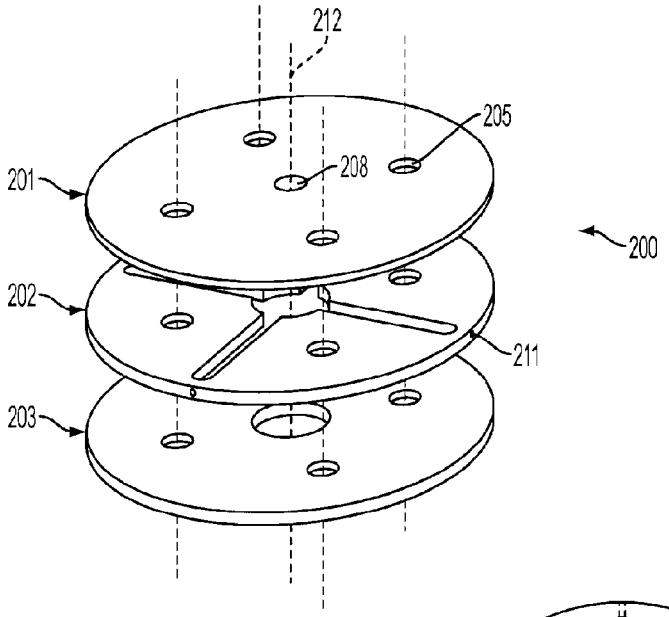
FIG. 2 depicts an embodiment of the present spinnerets that includes three plates with multiple peripheral openings.
Figure 2B:
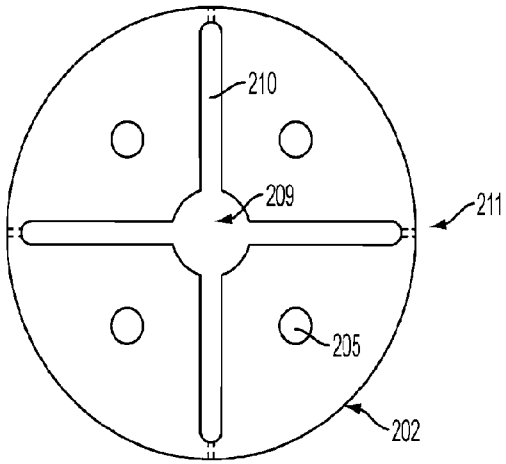
Figure 2C:
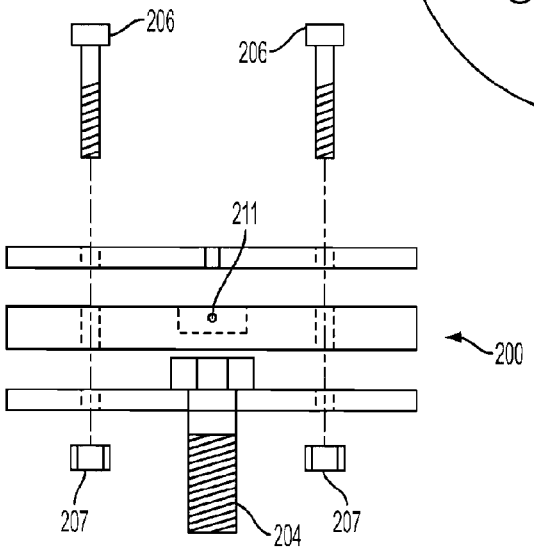

Another type of spinneret of the present spinnerets is shown in FIG. 2. Spinneret 200 comprises a cover plate 201, a base plate 202, and a holding plate 203, the latter of which is shown threaded with a holding plate screw 204. The cover plate features holes 205 through which plate securing screws 206 may be employed to secure the three plates together along with the plate securing nuts 207. The cover plate also features a material injection inlet 208. A reservoir 209 in the base plate 202 for holding material is joined to multiple channels 210 such that material held in the reservoir 209 may exit the spinneret through the openings 211. For this type of spinneret, typical amounts of material range from 5-100 mL, but amounts less than this may be used as well as amounts greater than this, as the size of the reservoir and the spinneret may each vary. The spin axis of this spinneret 212 extends centrally and vertically through the reservoir 209, perpendicular to each of the three plates 201, 202 and 203. This spinneret may be used for melt spinning or solution spinning, in certain embodiments, a spinneret of this type is spun for 10-500 seconds to form superfine fibers. This spinneret may also be operated in a continuous mode for longer amounts of time.

Figure 3:
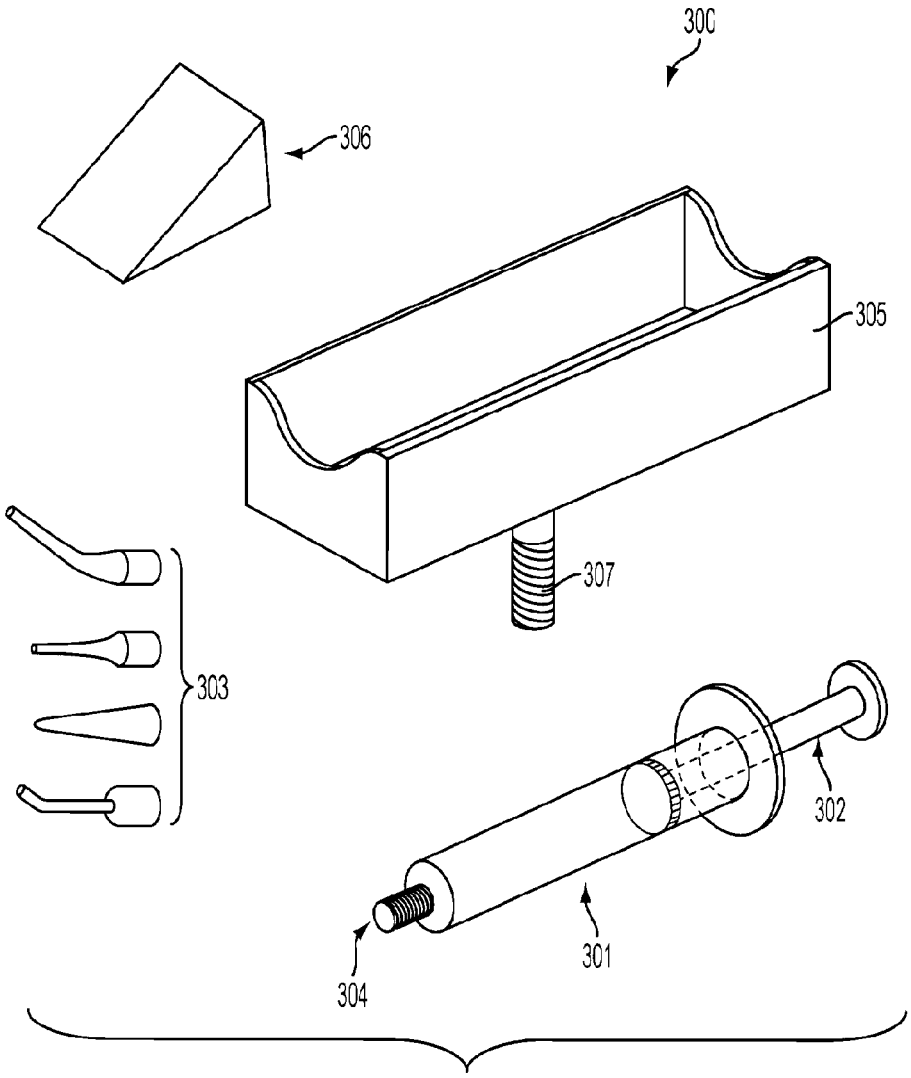
FIG. 3 depicts an embodiment of the present spinnerets that includes a syringe, plunger and various needles as well as a syringe support device.

FIG. 3 shows another embodiment of the present spinnerets. Spinneret 300 comprises a syringe 301 equipped with a plunger 302 and a variety of needles 303 that may optionally be connected to the syringe 301 at the opening 304. The syringe 301 may be placed atop the syringe support device 305. The syringe support device 305 may also serve as a superfine fiber collection device, as discussed herein. The wedge 306 may optionally be positioned between the syringe 301 and the syringe support device 305 in order to alter the angle at which the material is ejected from the syringe 301. A threaded joint 307, such as a universal threaded joint, is shown attached to the syringe support device 305.

Figure 4A:
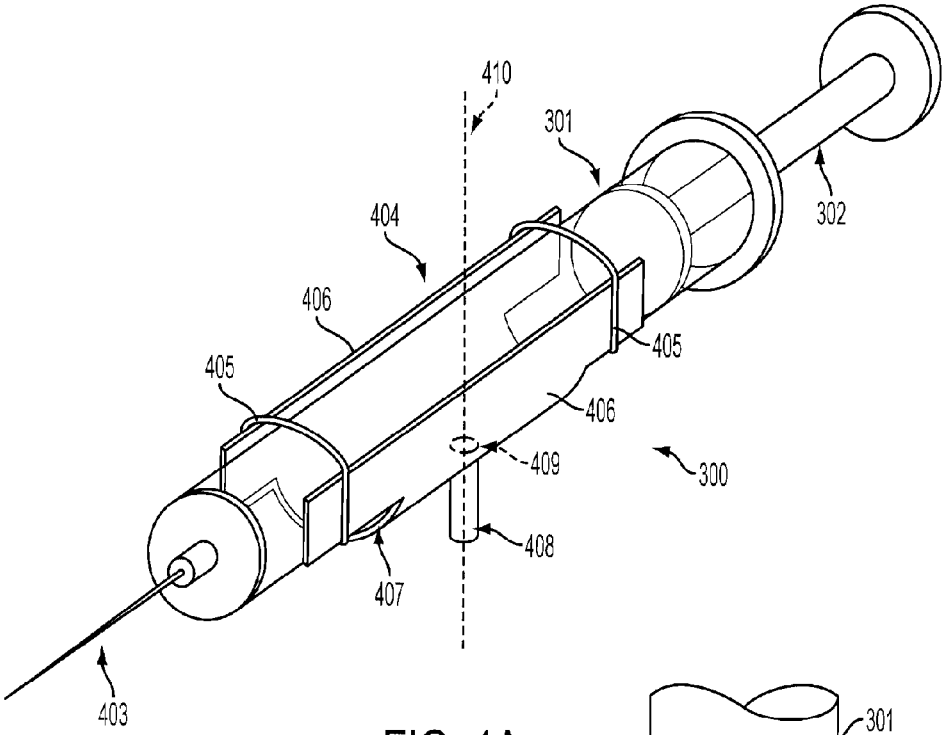
FIG. 4 depicts an embodiment of the present spinnerets that includes a syringe secured to a syringe support device, where the syringe is equipped with a needle and a plunger.
Figure 4B:
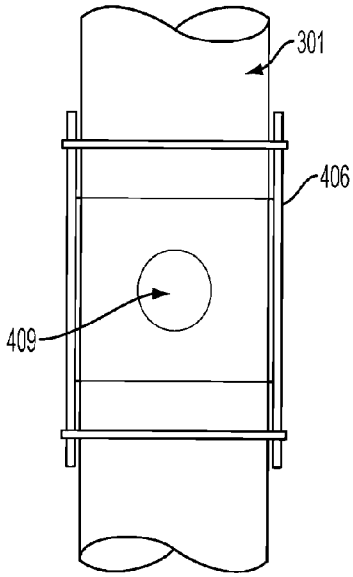

FIG. 4 shows a spinneret, such as spinneret 300, in assembled form. A syringe 301 equipped with a plunger 302 and a needle 403 is secured to a syringe support device 404 using two clamps 405. Typically, 10-500 mL of material are placed in the syringe, but this amount may vary depending on the size of syringe. The syringe support device comprises two walls 406 and a base 407. The walls 406 may be straight or cylindrical (curved). Superfine fibers may collect on the exterior of walls 406 as they exit a spinneret like spinneret 300: thus this syringe support device may also act as a superfine fiber collection device. A threaded joint 408, such as a universal threaded joint, is shown attached to the syringe support device 404 at the hole 409. The spin axis 410 of this spinneret extends centrally and vertically through the hole 409. This spinneret may be used for solution spinning. In certain embodiments, a spinneret of this type is spun for 10-1,000 seconds to form superfine fibers. This spinneret may also be operated in a continuous mode for longer amounts of time.

Figure 5A:
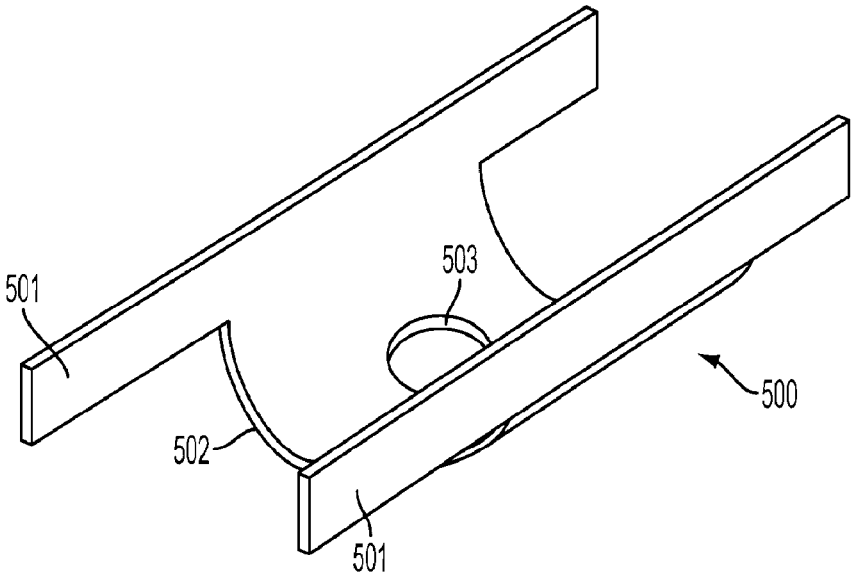
FIG. 5 depicts an embodiment of the present syringe support devices. This syringe support device may also be a superfine fiber collection device.
Figure 5B:
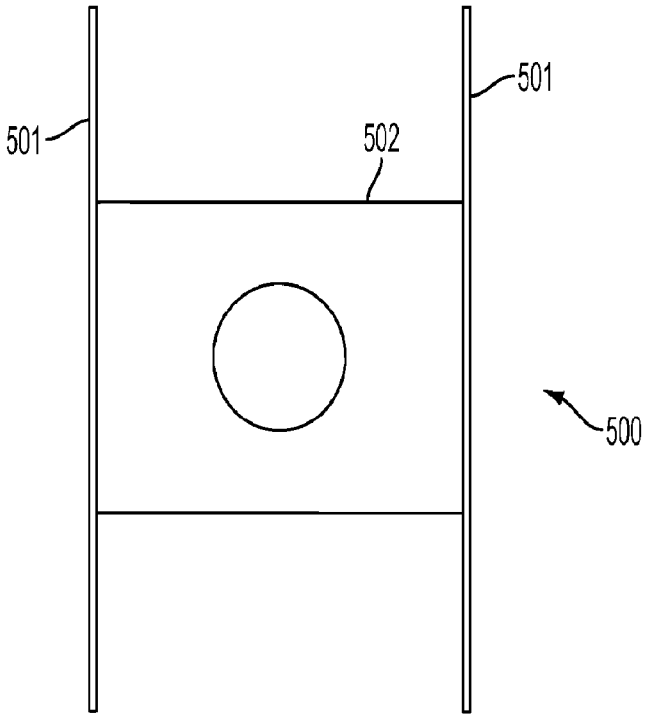

A syringe support device 500 that may also act as a superfine fiber collection device is shown in FIG. 5. The device comprises two walls 501 and a base 502 onto which a syringe may be placed. The walls 501 may be cylindrical (curved). Base 502 includes a hole 503 is configured to attach to a driver, such as through a universal threaded joint. Superfine fibers may collect on the exterior of walls 501 as they exit a spinneret like spinneret 300: thus this syringe support device may also act as a superfine fiber collection device.

Figure 6:
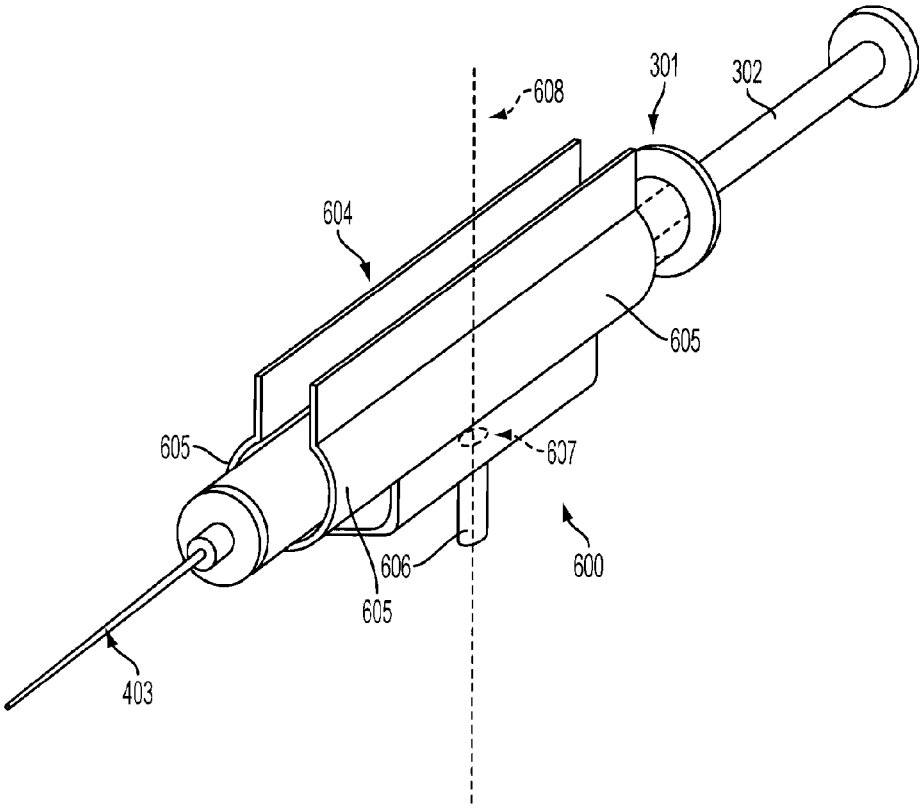
FIG. 6 depicts an embodiment of the present spinnerets that includes a syringe secured to a syringe support device, where the syringe is equipped with a needle and a plunger.

FIG. 6 shows spinneret 600, which comprises a syringe 301 equipped with a plunger 302 and a needle 403. The syringe 301 is held by the syringe support device 604 through tension between opposing cylindrical walls 605. Non-limiting mechanisms for attachment may include a snap fit or an adhesive joint. The syringe support device 604 may also act as a superfine fiber collection device by collecting superfine fibers as they exit spinneret 600, such as on the exterior of walls 605. A threaded joint 606, such as a universal threaded joint, is shown attached to the syringe support device 604 at the hole 607. The spin axis 608 of this spinneret extends centrally and vertically through the hole 607. Spinneret 600 may be used for solution spinning. Typically, 10-500 mL of material are placed in the syringe, but this amount may vary depending on the size of syringe. In certain embodiments, a spinneret of this type is spun for 10-1,000 seconds to form superfine fibers. This spinneret may also be operated in a continuous mode for longer amounts of time.

Figure 7:
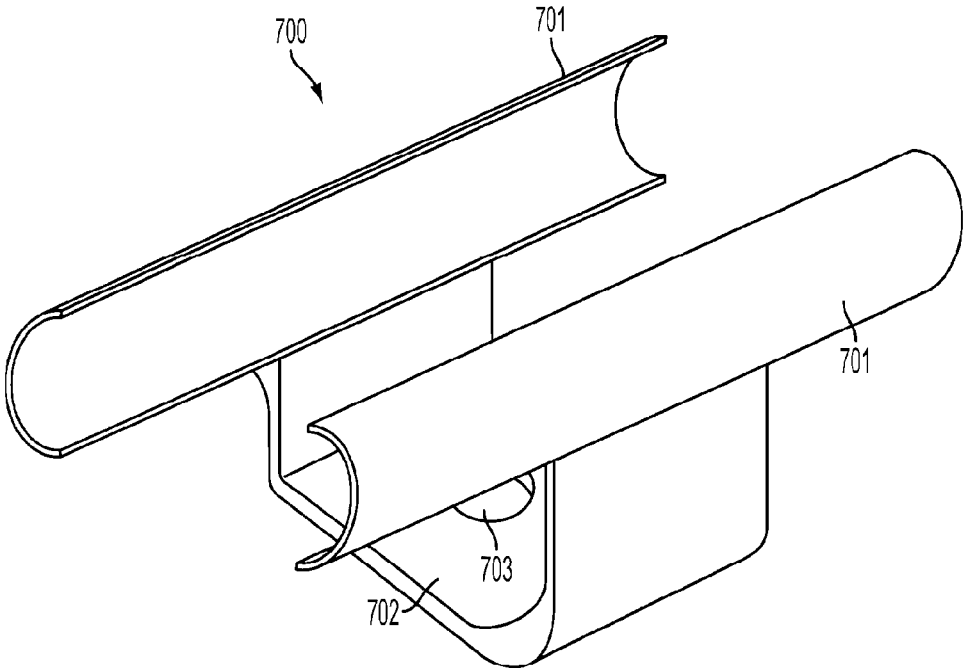
FIG. 7 depicts an embodiment of the present syringe support devices. This syringe support device may also be a superfine fiber collection device.

FIG. 7 shows a syringe support device 700 that may act as a superfine fiber collection device. Syringe support device 700 includes opposing arcuate (curved) walls 701 configured to contact the cylindrical outer wall of a syringe, and a base 702 that includes a hole 703. Superfine fibers may collect on the exterior of walls 701 as they exit a spinneret like spinneret 300: thus this syringe support device may also act as a superfine fiber collection device.

Figure 8A:
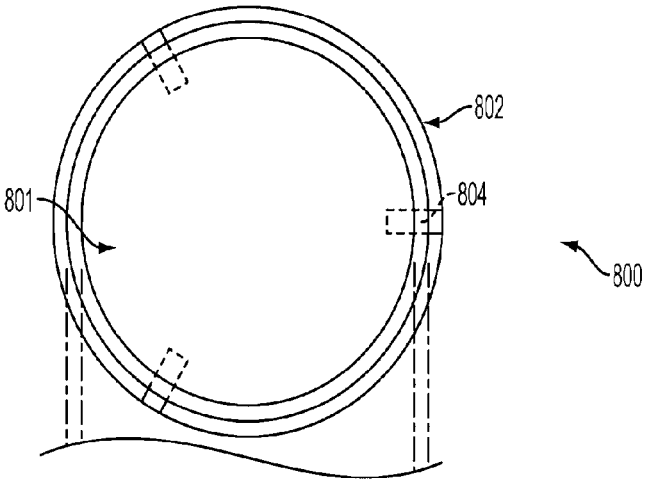
FIG. 8 depicts an embodiment of the present spinnerets that includes a reservoir that is a concave cavity.
Figure 8B:
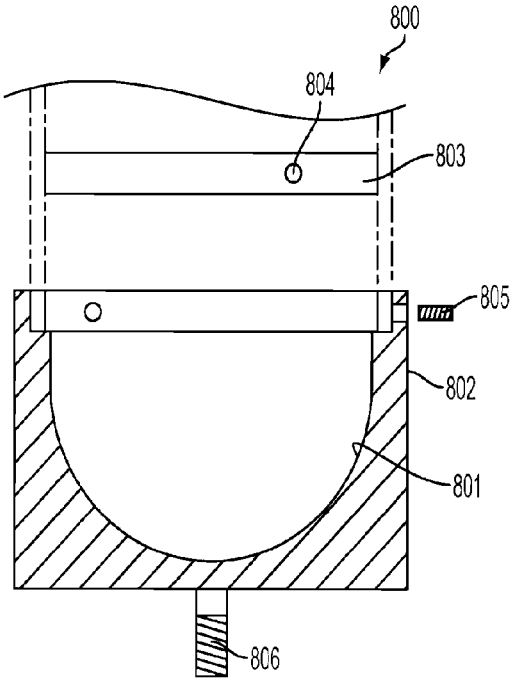
Figure 8C:
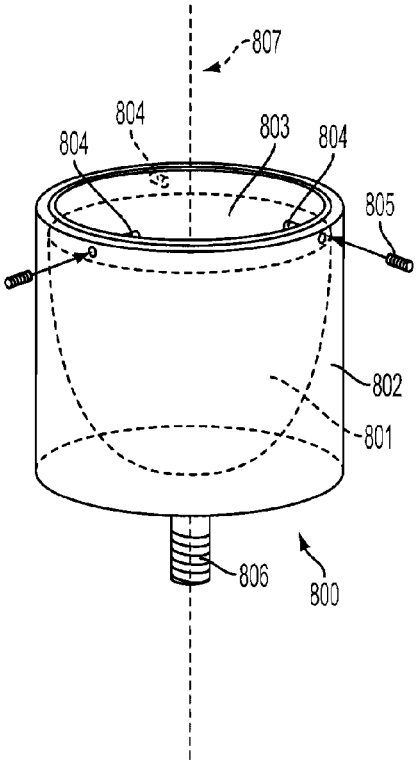

Yet another spinneret of the present spinnerets is shown in FIG. 8. Spinneret 800 includes a reservoir 801 in the shape of a concave cavity is centered within the wall 802 of the spinneret. Typically, 100-1,000 mL of material are placed in the reservoir, but amounts less than this may be used as well as amounts greater than this, as the size of the reservoir and the spinneret may each vary. Spinneret 800 also includes lid 803, which includes threaded holes 804 that allow the lid 803 to be secured to the reservoir 801 using one or more screws 805. Not every threaded hole 804 need be used for securing the lid to the reservoir 801: at least one hole 804 may also act as an opening through which material may exit during spinning. In certain embodiments, material may exit the reservoir 801 via a gap between the lid 803 and the reservoir. A threaded joint 806, such as a universal threaded joint, is shown attached to the base of the spinneret. The spin axis 807 of this spinneret extends centrally and vertically through the reservoir 801. This spinneret may be used for melt spinning or solution spinning. In certain embodiments, a spinneret of this type is spun for 10-5,000 seconds to form superfine fibers. This spinneret may also be operated in a continuous mode for longer amounts of time.

Figure 9A:
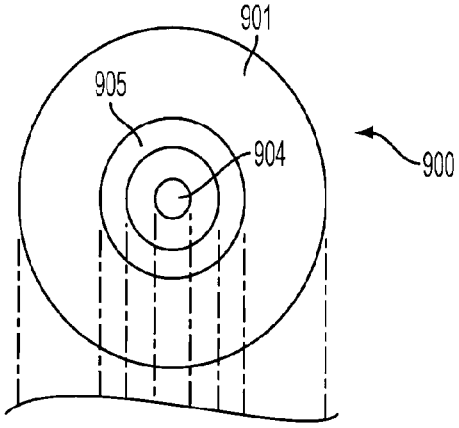
FIG. 9 depicts an embodiment of the present spinnerets that includes a top plate and a bottom plate, where the top and bottom plates are separated by a micro-mesh material.
Figure 9B:
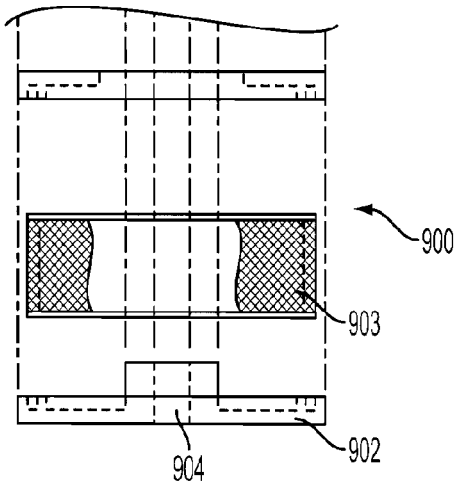
Figure 9C:
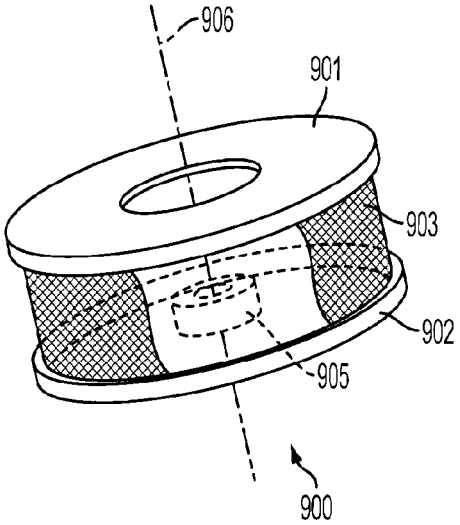

FIG. 9 depicts spinneret 900 including a top plate 901 and a bottom plate 902 separated by a micro-mesh material 903. The micro-mesh material may comprise, for example, stainless steel or plastic. Such micro-mesh material may be obtained from commercial sources, such as MSC Industrial Supply Co. (cat. no. 52431418). The distance spanned by the micro-mesh between top plate 901 and bottom plate 902 may range, for example, between 1-10" (e.g., 1", 2", 3", 4", 5", 6", 7", 8", 9", or 10", or any value or range therein). A hole 904 in the bottom plate 902 that extends through a bottom connector 905 allows for connection for a threaded joint, such as a universal threaded joint. Spinneret 900 is typically used for melt spinning. Solid granules (e.g., polymer beads) may be placed in the bottom plate 902, which acts as storage, rather than a reservoir as with certain other spinnerets. However, it is possible to modify this bottom plate 902 to act a reservoir for liquid material by raising the solid wall of this plate. With such a modification, it is possible to use this spinneret for solution spinning. The spin axis 906 of this spinneret extends centrally and vertically through the hole 904. This spinneret may also be operated in a continuous manner.

2. Superfine Fiber Collection Devices and Methods

Superfine fibers created using the present methods or the present apparatuses may be collected using a variety of superfine fiber collection devices. Three exemplary devices are discussed below, and each of these devices may be combined with one another.

Figure 10:
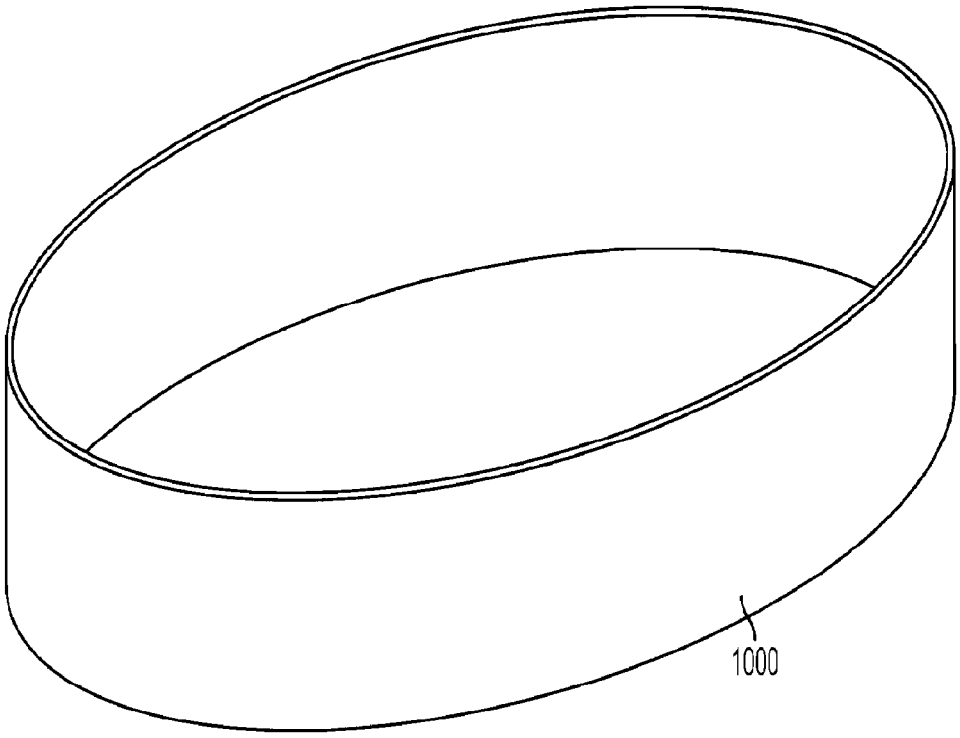
FIG. 10 depicts an embodiment of the present superfine fiber collection devices.

The simplest method of superfine fiber collection is to collect the fibers on the interior of a collection wall that surrounds a spinneret (see, e.g., collection wall 1000 shown in FIG. 10). Superfine fibers are typically collected from collection walls similar to collection wall 1000 as unwoven superfine fibers.

The aerodynamic flow within the chamber influences the design of the superfine fiber collection device (e.g., height of a collection wall or rod; location of same). Aerodynamic flow may be analyzed by, for example, computer simulation, such as Computational Fluid Dynamics (CFD).

The spinning spinneret develops an aerodynamic flow within the confinement of the apparatuses described herein. This flow may be influenced by, for example, the speed, size and shape of the spinneret as well as the location, shape, and size of the superfine fiber collection device. An intermediate wall placed outside the collection wall may also influence aerodynamic flow. The intermediate wall may influence the aerodynamic flow by, for example, affecting the turbulence of the flow. Placement of an intermediate wall may be necessary in order to cause the superfine fibers to collect on a superfine fiber collection device. In certain embodiments, placement of an intermediate wall is determined by a method comprising operating a spinneret in the presence of a superfine fiber collection device and an intermediate wall, observing whether or not superfine fibers are collected on the superfine fiber collection device, and if they are not, then moving the intermediate wall (e.g., making its diameter smaller or larger, or making the intermediate wall taller or shorter) to perform the experiment again to see if superfine fibers are collected. Repetition of this process may occur until superfine fibers are collected on the superfine fiber collection device.

A stagnation zone may develop at, for example, the site of the spinning spinneret (such as centered at the spinning spinneret). A spinneret is typically designed such that it does not disturb the stagnation zone. One knows when a spinneret is not designed properly with respect to the stagnation zone because superfine fibers will not form correctly (e.g., they will not form in a desired manner). For example, regarding the embodiments of the present invention shown in FIG. 5 and FIG. 7, these embodiments were designed with a purpose of collecting mat superfine fibers. If mat superfine fibers were not collected, one reason was likely that the embodiment was disturbing the stagnation zone. Thus, with respect to the embodiments of FIG. 5 and FIG. 7, it was determined that to minimize disturbance of the stagnation zone, typically the syringe support device/superfine fiber collection device should be about the size of the syringe, ±20% (in terms of both diameter and length). In certain embodiments employing syringes, design of a syringe support device may be done using this parameter in mind.

Typically, fibers are collected on the collection wall or settle onto other designed structure(s) of stagnation zone. It is important to realize that temperature plays an important role on the size and morphology of fibers. If the collection wall, for example, is relatively hotter than the ambient temperature, fibers collected on the collection wall may coalesce at this temperature leading to bundling of nanofibers and/or welding of individual fibers on several points. To avoid this, in some embodiments, the temperature of the intermediate wall can be controlled, such as, for example, by blowing gas (e.g., air, nitrogen) between the two (intermediate and collection) walls. By controlling the flow rate, type, and temperature of this blowing gas, it is possible to control the temperature and morphology of the superfine fibers. Key design parameters can include wall (height, location, etc.) and gas (temperature, type, etc.) characteristics.

The intermediate wall can also be used to control, adjust, and/or influence the aerodynamic flow within the apparatus. Aerodynamic flow typically guides the superfine fibers to rest on one or more superfine fiber collection devices. If, upon formation, loose superfine fibers float in an apparatus of the present apparatuses (due to their very small mass) without coming to rest on one or more superfine fiber collection devices, it is likely that, for example, the intermediate wall is not positioned correctly, or the superfine fiber collection device(s) is not correctly positioned, and/or the aerodynamic flow is not properly understood. An intermediate wall is typically taller than any collection wall that may be used (e.g., 1.5 times as high as the collection wall), and surrounds such a collection wall (e.g., 2-4" (e.g., 3") away from the collection wall; or, for example, the intermediate wall may be 10-30% larger (e.g., 20% larger) than the collection wall). An intermediate wall may be segmented, and may have one or more holes in it.

Figure 11:
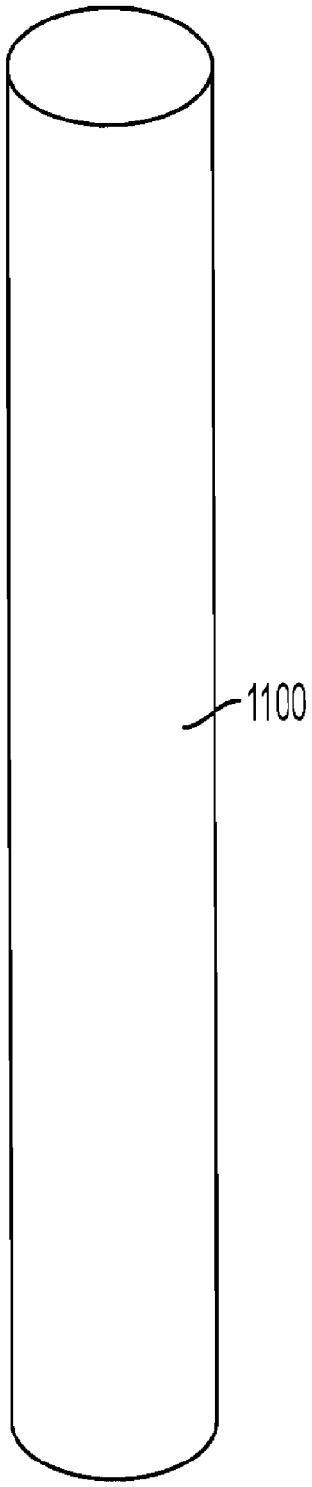
FIG. 11 depicts an embodiment of the present superfine fiber collection devices.

If the objective is to collect unidirectional and long superfine fibers, a collection rod may be designed and positioned at an appropriate distance from the spinneret. An example of this is collection rod 1100 shown in FIG. 11. One or more collection rods (like rod 1100) are typically placed at a distance of 5-7" (e.g., 6") from the center of the spinneret. One or more collection rods may be positioned along the perimeter of the interior of a collection wall. A collection rod may be stationary during superfine fiber collection, or it may be rotated during collection. Rods of this nature may be made from any suitable material that will give them significant rigidity, such as polycarbonate and metals (e.g., aluminum, stainless steel). In embodiments of the present apparatuses where the rod or rods will be rotated, the rods may be secured to a structure like a plate that is connected, along with the spinneret, to a driver. The rod-holding plate and spinneret may be geared to each other in way that allows both to rotate in the same or opposite directions as a result of the rotation of a single driver. The diameter of a rod is typically 0.20"-0.30" (e.g., 0.25"), but a variety of sizes may be used. The rod may, for example, be rotated at a speed of 50 to 250 RPM.

Figure 12A:
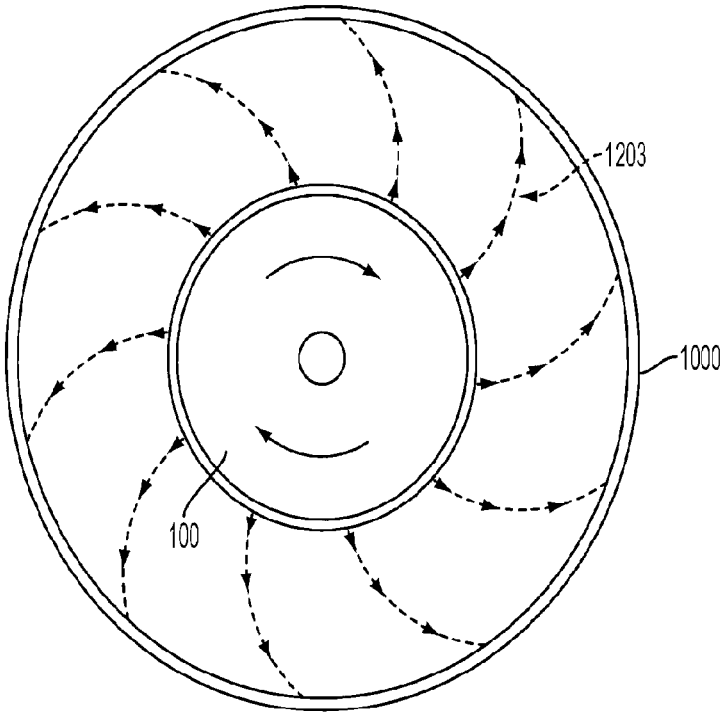
FIG. 12 depicts an embodiment of the present spinnerets (see FIG. 1) depicted in motion where superfine fibers are collected on an embodiment of the present superfine fiber collection devices (see FIG. 10).
Figure 12B:
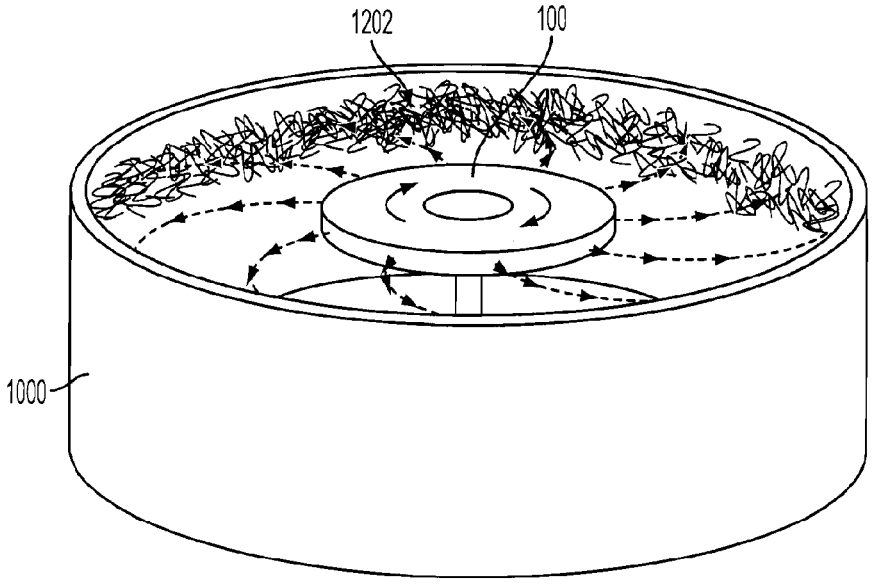

Drawings depicting superfine fiber collection in action are provided in FIGS. 12-17. FIG. 12 shows superfine fiber creation using spinneret 100 of FIG. 1 that is spinning clockwise about a spin axis, where material is exiting the spinneret as superfine fibers 1202 along various pathways 1203. Those superfine fibers are being collected on the interior of the surrounding collection wall 1000 of FIG. 10.

Figure 13A:
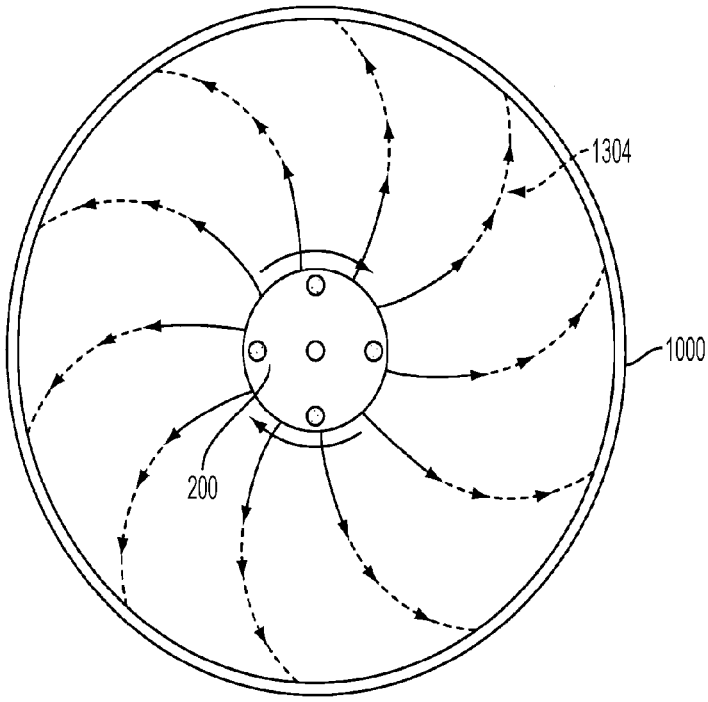
FIG. 13 depicts an embodiment of the present spinnerets (see FIG. 2) depicted in motion where superfine fibers are collected on an embodiment of the present superfine fiber collection devices (see FIG. 10).
Figure 13B:
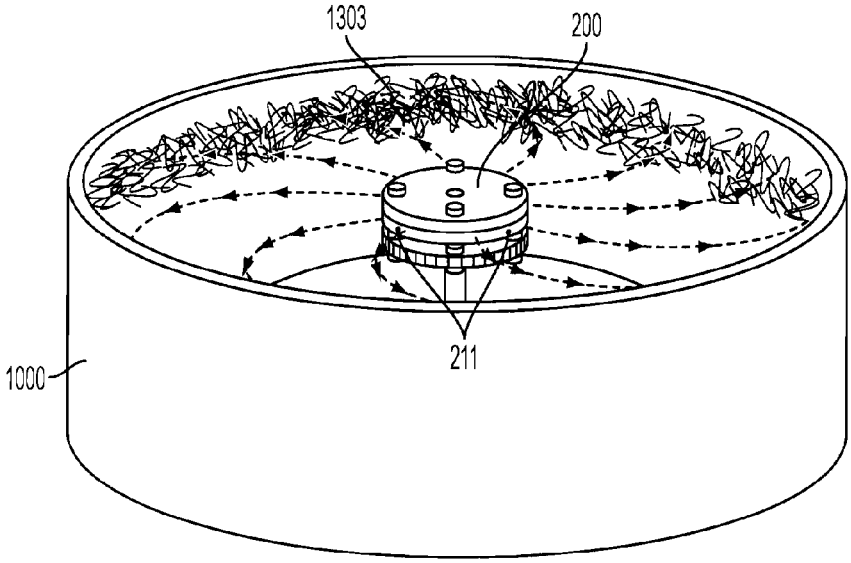

FIG. 13 shows superfine fiber creation using spinneret 200 of FIG. 2 that is spinning clockwise about a spin axis, where material is exiting openings 211 in the spinneret as superfine fibers 1303 along various pathways 1304. Those superfine fibers are being collected on the interior of the surrounding collection wall 1000 of FIG. 10.

Figure 14A:
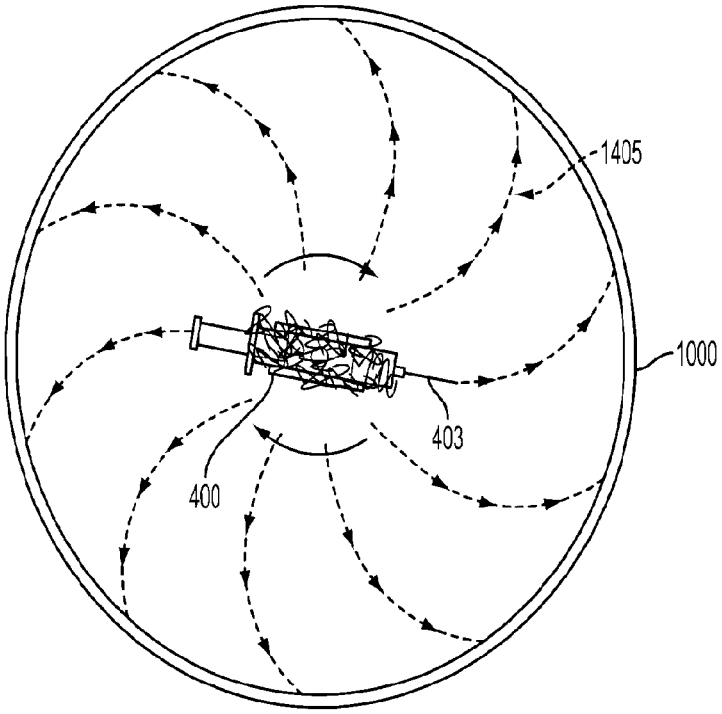
FIG. 14 depicts an embodiment of the present spinnerets (see FIG. 4) depicted in motion where superfine fibers are collected on an embodiment of the present superfine fiber collection devices (see FIG. 10).
Figure 14B:
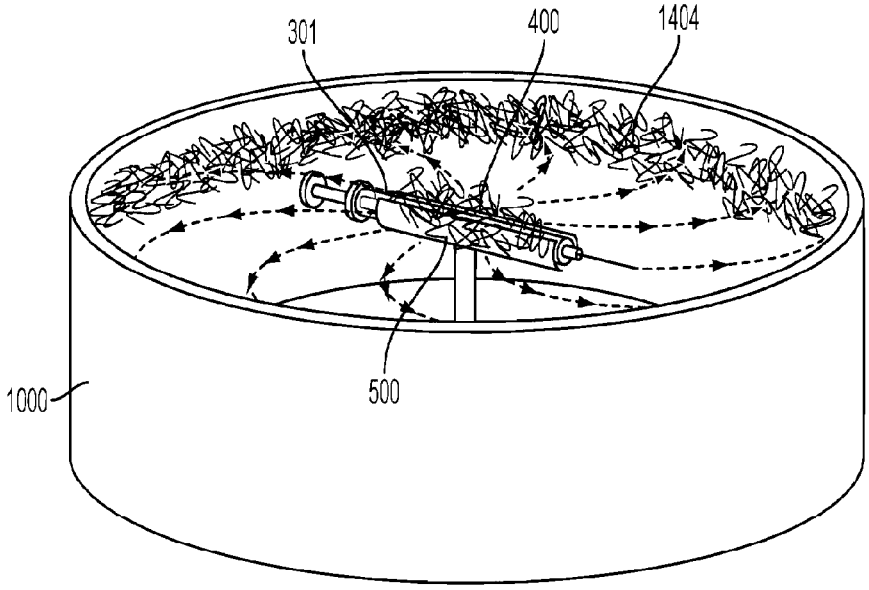

FIG. 14 shows superfine fiber creation using spinneret 400 of FIG. 4 that is spinning clockwise about a spin axis, where material is exiting the needle 403 of the syringe 301 as superfine fibers 1404 along various pathways 1405. Those superfine fibers are being collected on the interior of the surrounding collection wall 1000 of FIG. 10 as well as on the syringe support device 500 (with curved walls) of FIG. 5, such that the syringe support device also acts as a superfine fiber collection device.

Figure 15A:
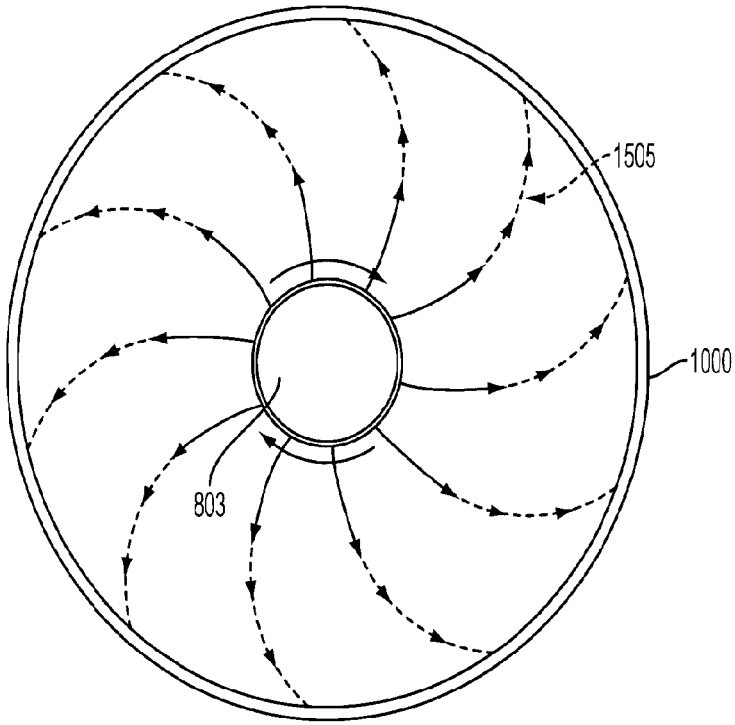
FIG. 15 depicts an embodiment of the present spinnerets (see FIG. 8) depicted in motion where superfine fibers are collected on an embodiment of the present superfine fiber collection devices (see FIG. 10).
Figure 15B:
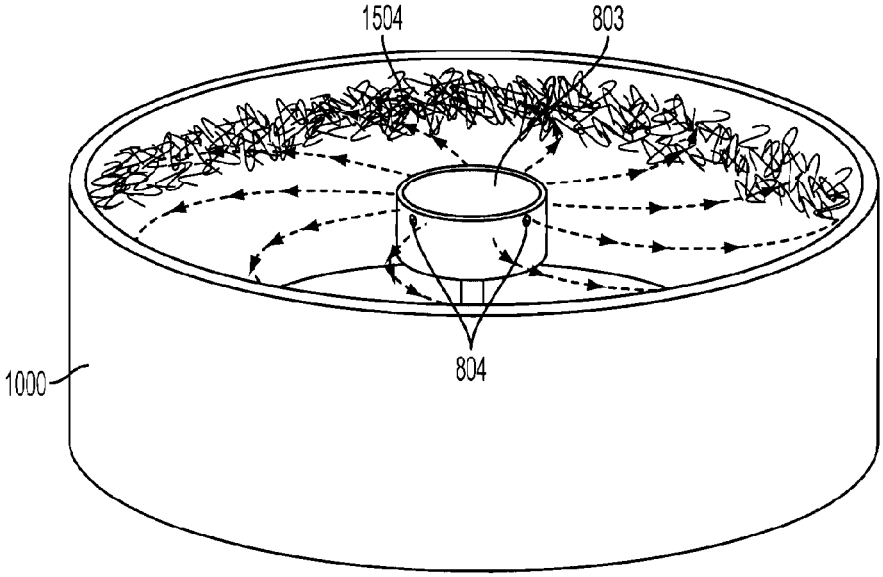

FIG. 15 shows superfine fiber creation using spinneret 800 of FIG. 8 that is spinning clockwise about a spin axis, where material that is placed in the reservoir 803 of the spinneret 800 is exiting the openings 804 as superfine fibers 1504 along various pathways 1505. Those superfine fibers are being collected on the interior of the surrounding collection wall 1000 of FIG. 10.

Figure 16A:
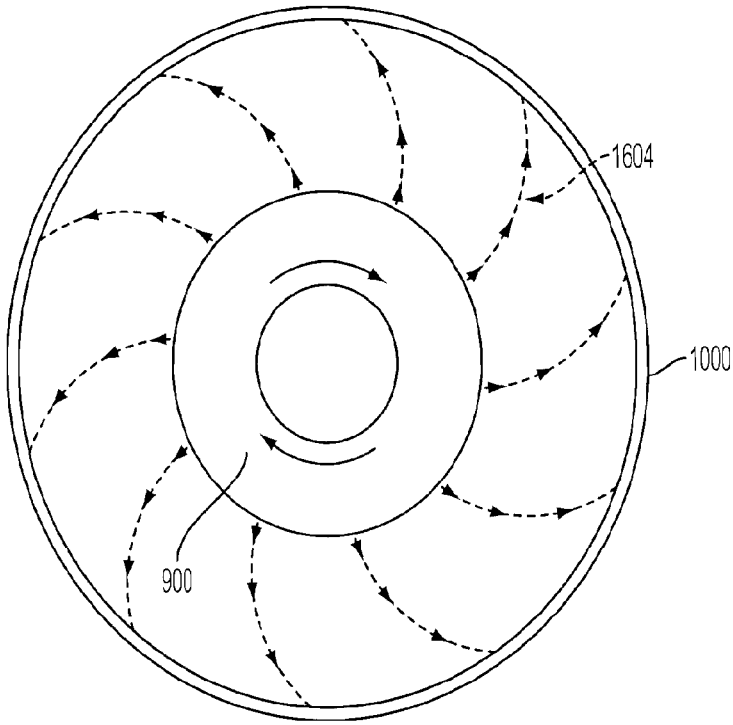
FIG. 16 depicts an embodiment of the present spinnerets (see FIG. 9) depicted in motion where superfine fibers are collected on an embodiment of the present superfine fiber collection devices (see FIG. 10).
Figure 16B:
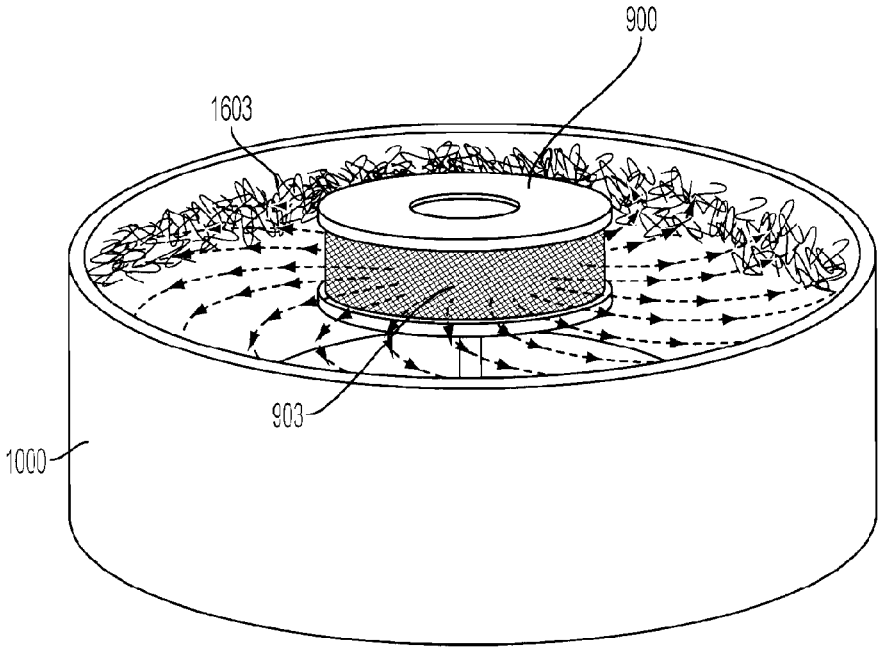

FIG. 16 shows superfine fiber creation using spinneret 900 of FIG. 9 that is spinning clockwise about a spin axis, where material is exiting the openings of the micro-mesh 903 as superfine fibers 1603 along various pathways 1604. Those superfine fibers are being collected on the interior of the surrounding collection wall 1000 of FIG. 10.

Figure 17A:
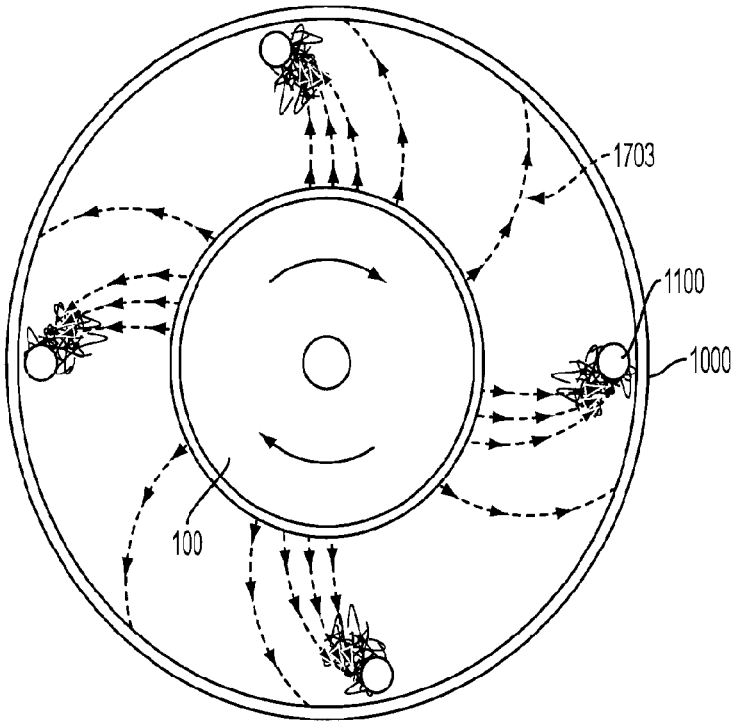
FIG. 17 depicts an embodiment of the present spinnerets (see FIG. 1) depicted in motion where superfine fibers are collected on multiple embodiments of the present superfine fiber collection devices (see FIG. 11).
Figure 17B:
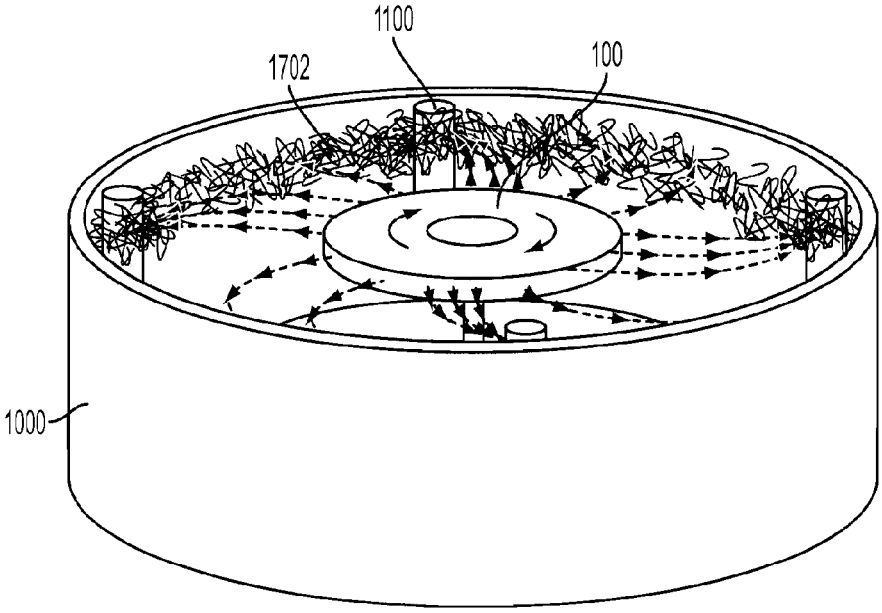

FIG. 17 shows superfine fiber creation using spinneret 100 that is spinning clockwise about a spin axis, where material is exiting the spinneret as superfine fibers 1702 along various pathways 1703. Those superfine fibers are being collected on the collecting rods 1100 (FIG. 11) and on the interior of the collection wall 1000 (FIG. 10).

3. Environment

The conditions of the environment in which superfine fibers are created may influence various properties of those fibers. For example, some metallic superfine fibers, such as iron superfine fibers, react with ambient air. For such applications, it is preferable to replace ambient air with an inert gas (e.g., nitrogen or argon). Humid conditions may detrimentally affect the surfaces of many polymeric superfine fibers, such as poly(ethylene oxide) (PEO). Thus, lowering humidity levels is preferable. Similarly, drugs may be required to be developed under sterile conditions that are not maintained in ambient conditions: a sterile environment is therefore preferred in such situations.

The "environment" refers to the interior space defined by the housing that surrounds the components of an apparatus as described herein. For certain uses, the environment may simply be ambient air. Air may be blown into the environment, if desired. For other uses, the environment may be subjected to low-pressure conditions, such as 1-760 mm Hg, or any range derivable therein using, for example, a vacuum pump. Alternatively, the environment may be subjected to high-pressure conditions, such as conditions ranging from 761 mm Hg up to 4 atm or higher using, for example, a high pressure pump. The temperature of the environment may be lowered or raised, as desired, through the use of heating and/or cooling systems, which are described below. The humidity level of the environment may be altered using a humidifier, and may range from 0-100% humidity. For certain applications, such as drug development, the environment may be rendered sterile. If the components of an apparatus are each made of, for example, stainless steel, all components may be individually sterilized and assembled, such as in a clean room. Every operator of such an apparatus must be appropriately cleaned and covered with gowns and mask. The sterile environment should be monitored for sterility: this may be done using methods known in the art.

4. Heating and Cooling Sources

Several types of heating and cooling sources may be used in apparatuses and methods as discussed herein to independently control the temperature of, for example, a spinneret, a collection wall, an intermediate wall, a material, and/or the environment within an apparatus.

Three non-limiting types of heat sources that may be employed include resistance heaters, inductive heaters and IR (Infra Red) heaters. Peltier or Thermoelectric Cooling (TEC) devices may be used for heating and/or cooling purposes. Cold gas or heated gas (e.g., air or nitrogen) may also be pumped into the environment for cooling or heating purposes. Each of these heaters and coolers may be purchased from commercial vendors. Conductive, convective, or radiation heat transfer mechanisms may be used for heating and cooling of various components of the apparatuses.

5. Apparatuses and Their Components

Various exemplary apparatuses are shown in FIGS. 18-24. It is to be understood that various components of these apparatuses (e.g., spinnerets, superfine fiber collection devices, heaters, coolers, thermal insulation) may be added, subtracted and interchanged as needed.

Components of apparatuses may be made from a variety of materials. In certain embodiments, the components of an apparatus may be made namely from stainless steel. For example, the spinneret, collection wall and housing may each be made from stainless steel. In this situation, the components may be used for, e.g., low melting metals like tin (232° C.), zinc (420° C.), silver (962° C.) and alloys thereof. In certain embodiments, ceramic components may be used for high melting alloys, such as gold (1064° C.) and nickel (1453° C.). Manipulation of high melting alloys may require blanketing the environment of the components with an inert gas, such as nitrogen or helium, with appropriate sealing of the housing.

a. Exemplary Apparatuses

Figure 18A:
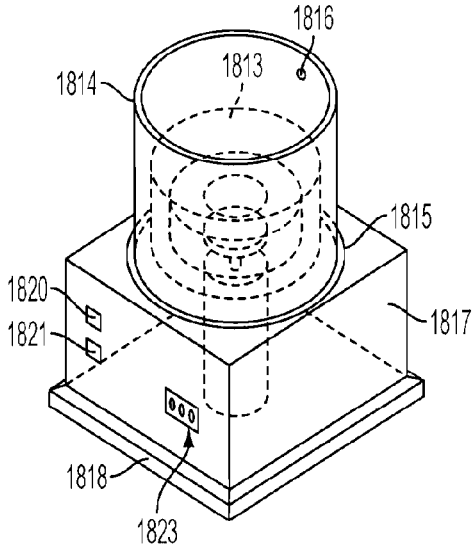
FIGS. 18-24 depict different embodiments of the present apparatuses.
Figure 18B:
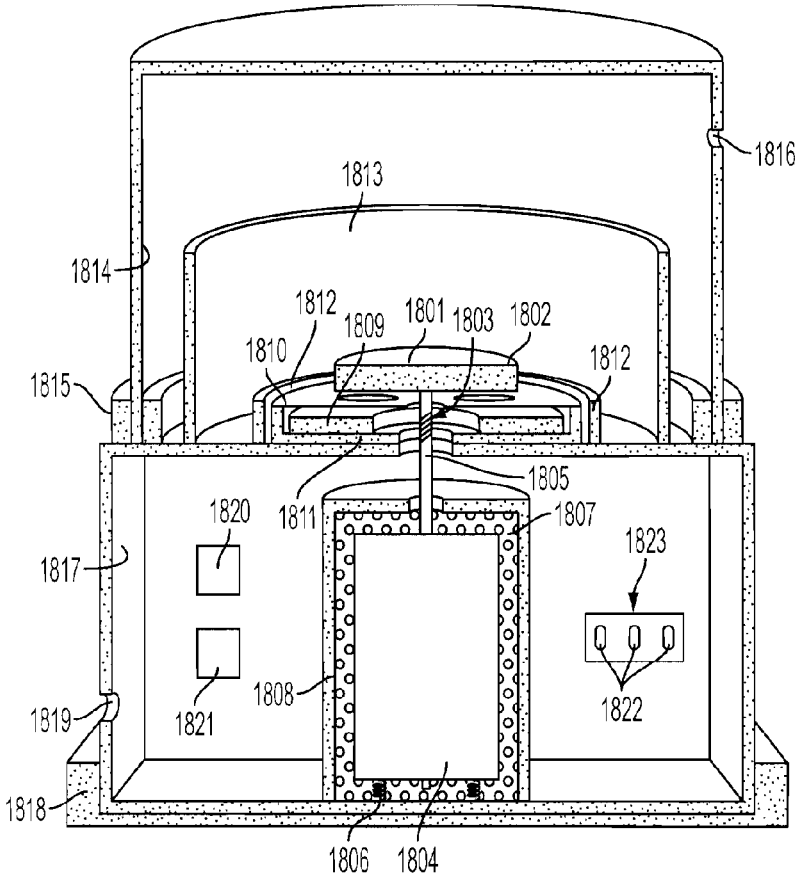

FIG. 18 shows a partially cut-away perspective view of one embodiment of the present apparatuses. Apparatus (or system) 1800 includes spinneret 1801, which has peripheral openings 1802 and is connected to a threaded joint 1803, such as a universal threaded joint, which, in turn, is connected to a motor 1804 via a shaft 1805. The motor 1804, such as a variable speed motor, is supported by support springs 1806 and is surrounded by vibration insulation 1807. A motor housing 1808 encases the motor 1804, support springs 1806 and vibration insulation 1807. A heating unit 1809 and is enclosed within an oven 1810 (e.g., a heat reflector wall) that has openings 1810*a* that direct heat (thermal energy) to the spinneret 1801. In the embodiment shown, heating unit 1809 sits on thermal insulation 1811. Surrounding the oven 1810 is a collection wall 1812, which, in turn, is surrounded by an intermediate wall 1813. A housing 1814 seated upon a seal 1815 encases the spinneret 1801, heating unit 1809, oven 1810, thermal insulation 1811, collection wall 1812 and intermediate wall 1813. An opening 1816 in the housing 1814 allows for introduction of elements (e.g., gas) into the internal environment of the apparatus, or allows elements (e.g., air) to be pumped out of the internal environment of the apparatus. The lower half of the apparatus is encased by a wall 1817 which is supported by a base 1818. An opening 1819 in the wall 1817 allows for further control of the conditions of the internal environment of the apparatus. Indicators for power 1820 and electronics 1821 are positioned on the exterior of the wall 1817 as are control switches 1822 and a control box 1823. Further description of these controls is provided below.

Figure 19A:
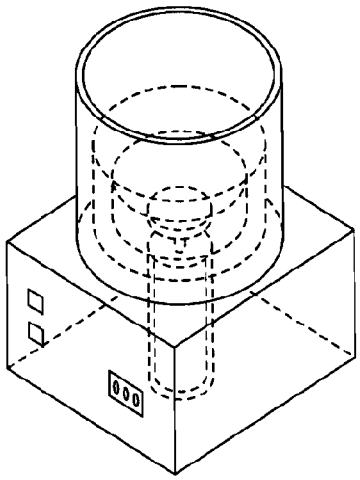
Figure 19B:
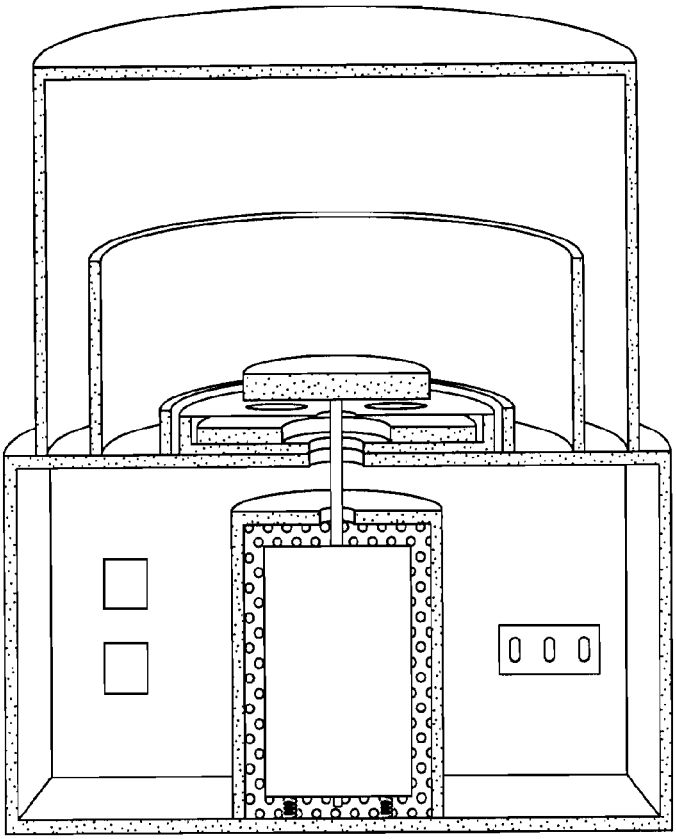
Figure 20A:
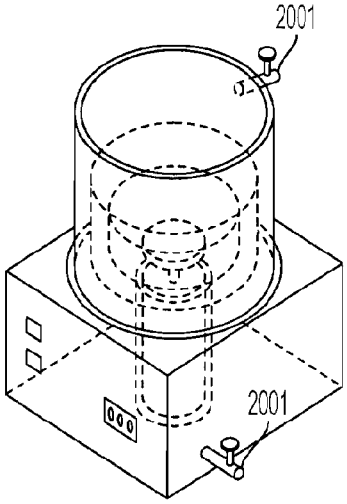
Figure 20B:
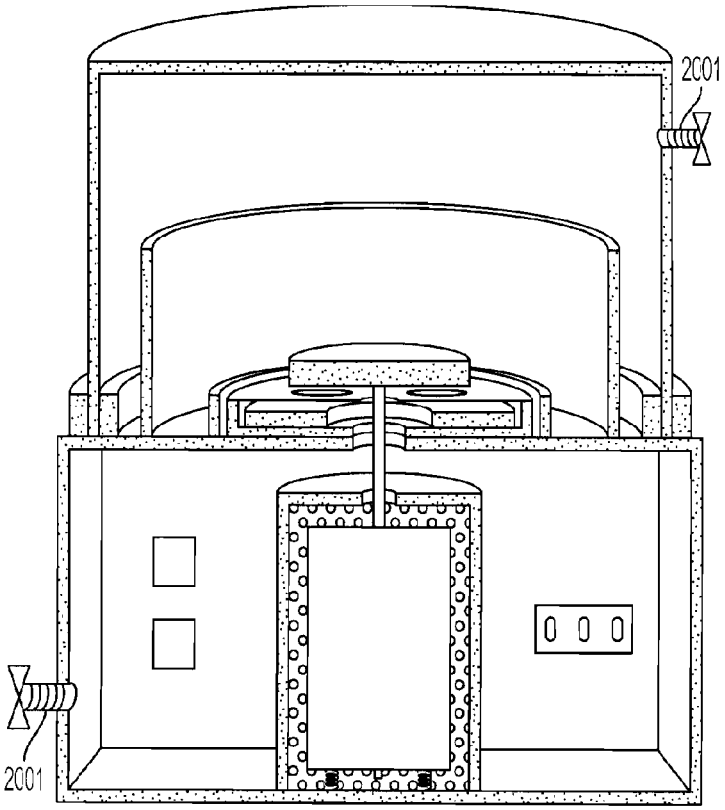
Figure 21A:
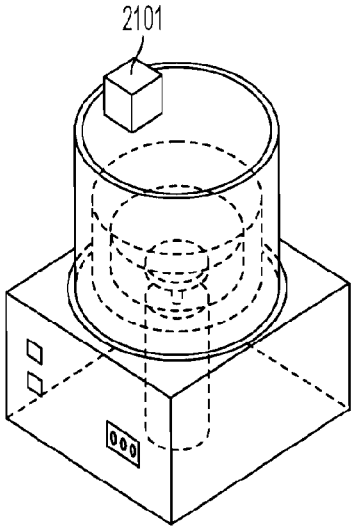
Figure 21B:
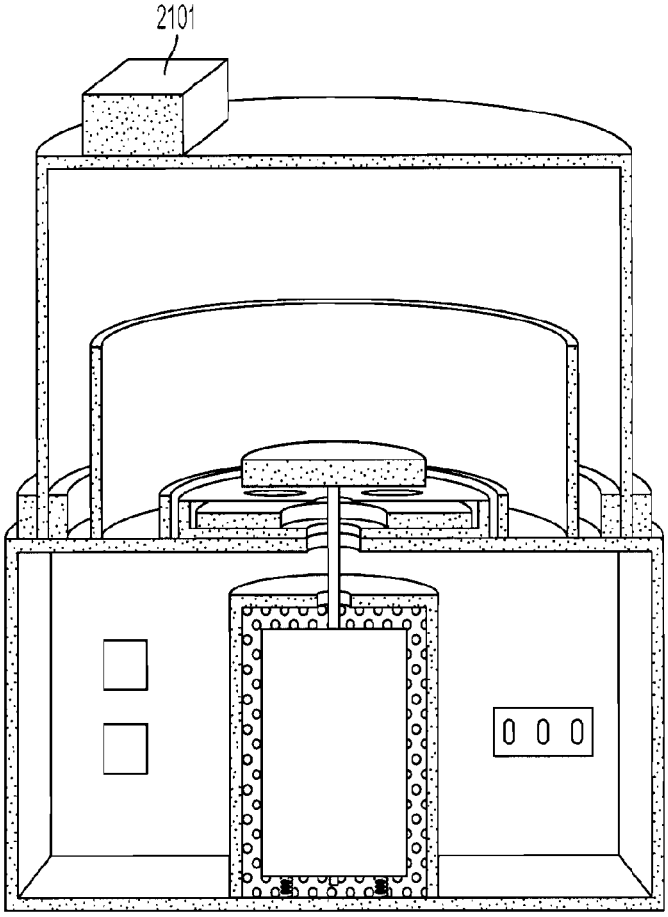
Figure 22A:
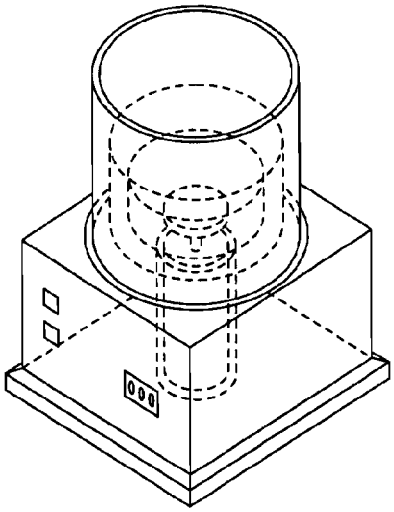
Figure 22B:
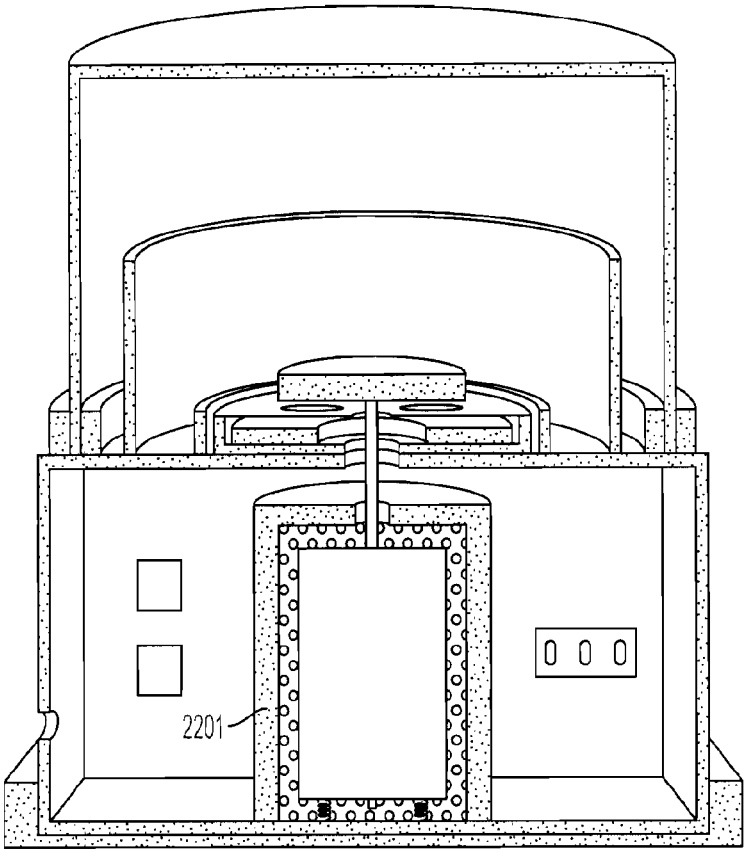

A partially cut-away perspective view of an apparatus that is substantially similar to the apparatus of FIG. 18 is shown in FIG. 19. However, in this figure, the openings 1816 and 1819 are not present. Yet another partially cut-away perspective view of an apparatus that is substantially similar to the apparatus of FIG. 18 is shown in FIG. 20. However, in this figure, valves 2001 are shown occupying the openings 1816 and 1819. These valves allow for controlled introduction and ejection of elements into and out of the interior environment of the apparatus. An additional partially cut-away perspective view of an apparatus that is substantially similar to the apparatus of FIG. 18 is shown in FIG. 21. The differences in this figure include the addition of a thermoelectric cooler 2101 that may cool the interior environment of the apparatus, and the openings 1816 and 1819 are not present. Other types of coolers may be employed with the apparatus of FIG. 18 as well. FIG. 22 shows another partially cut-away perspective view of an apparatus that is substantially similar to the apparatus of FIG. 18. In FIG. 22, the vibration insulation 1808 is replaced by high-frequency vibration insulation 2201. This allows for higher RPM spinning rates for a spinneret.

Figure 23A:
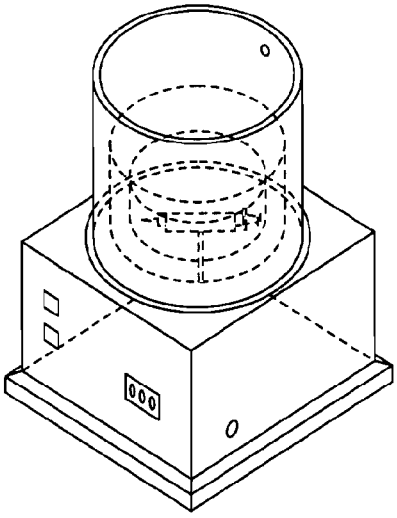
Figure 23B:
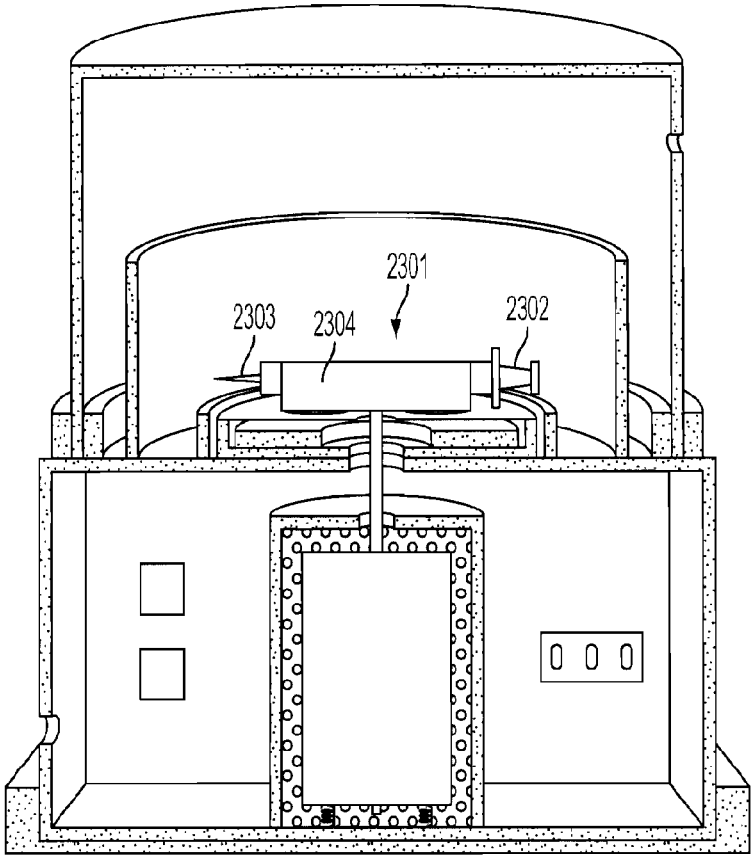

In FIG. 23, a cut-away perspective view of an apparatus that is substantially similar to the apparatus of FIG. 18 is shown. However, the spinneret of FIG. 18 has been replaced by a different type of spinneret. The spinneret of FIG. 23 is similar in style to the spinneret of FIG. 4, where a syringe 2301 equipped with a plunger 2302 and a needle 2303 is held by a syringe support device 2304. Other spinnerets may be employed with the apparatus of FIG. 23 as well.

Figure 24A:
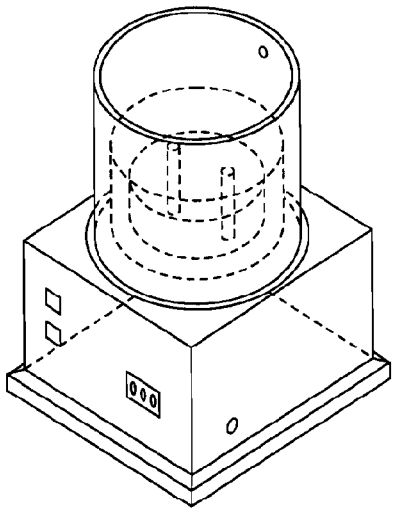
Figure 24B:
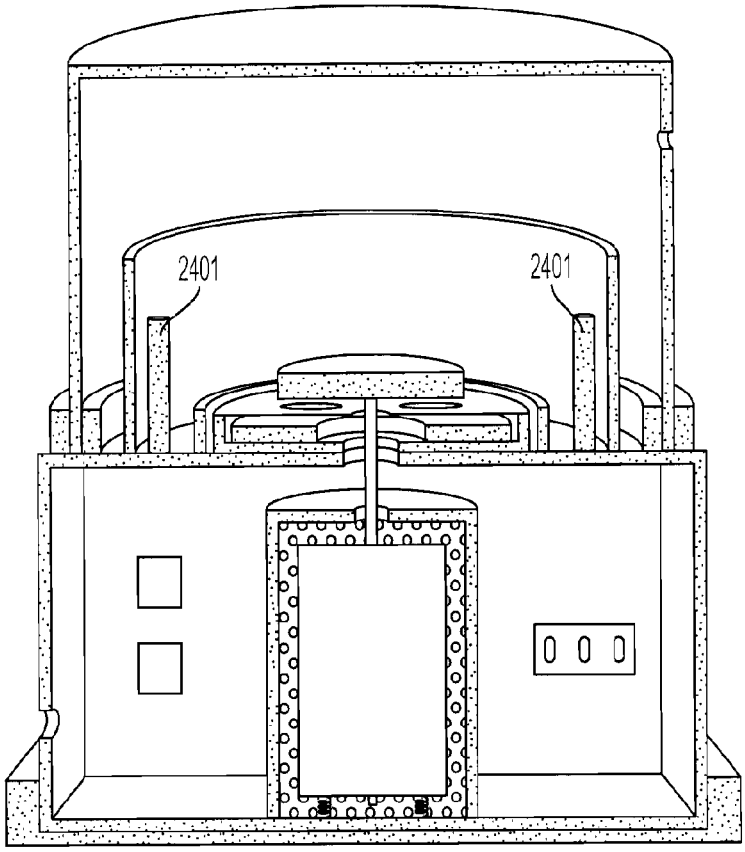
Figure 25:
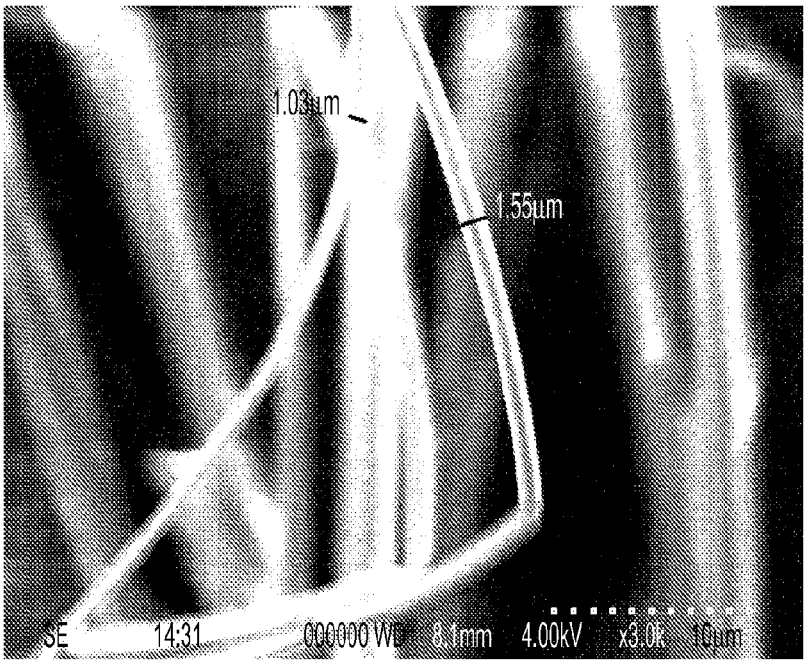
FIG. 25 depicts a photograph (3000×) of non-woven bismuth superfine fibers of single digit micron diameter, produced using melt spinning wherein a spinneret according to FIG. 1 was spun at 4,500 RPM at 300° C. (spinneret temperature) for 5 minutes.
Figure 26:
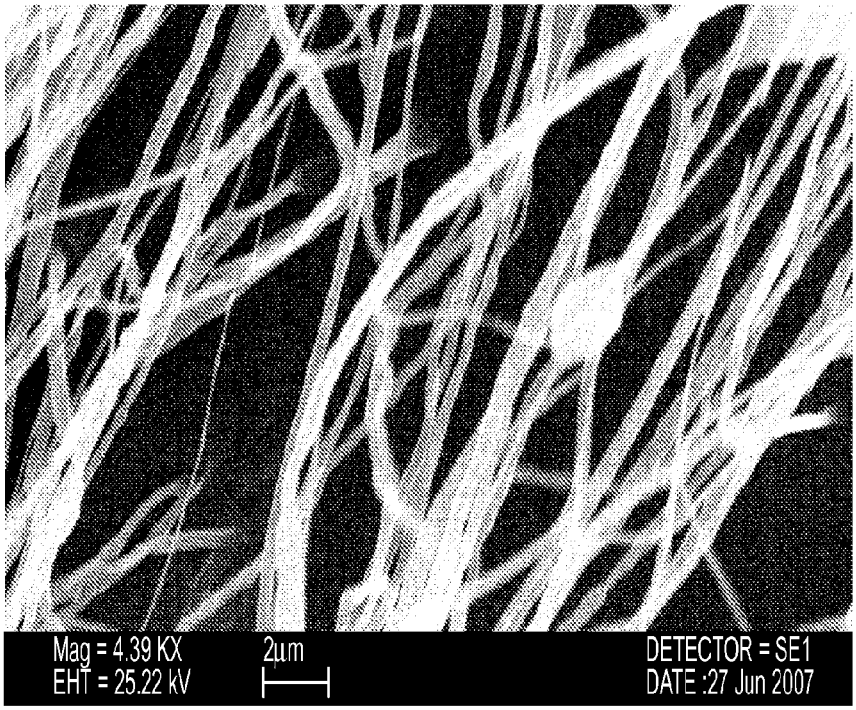
FIG. 26 depicts a photograph (~4390×) of non-woven polyethylene oxide (PEO) superfine fibers of micron, sub-micron and nano diameters, produced using solution spinning wherein a spinneret according to FIG. 1 was spun at 4,000 RPM at 50° C. (spinneret temperature) for 5 minutes, wherein fibers were collected on a superfine fiber collection device according to FIG. 10. The material that was spun was 5% by weight PEO in de-ionized water.
Figure 27:
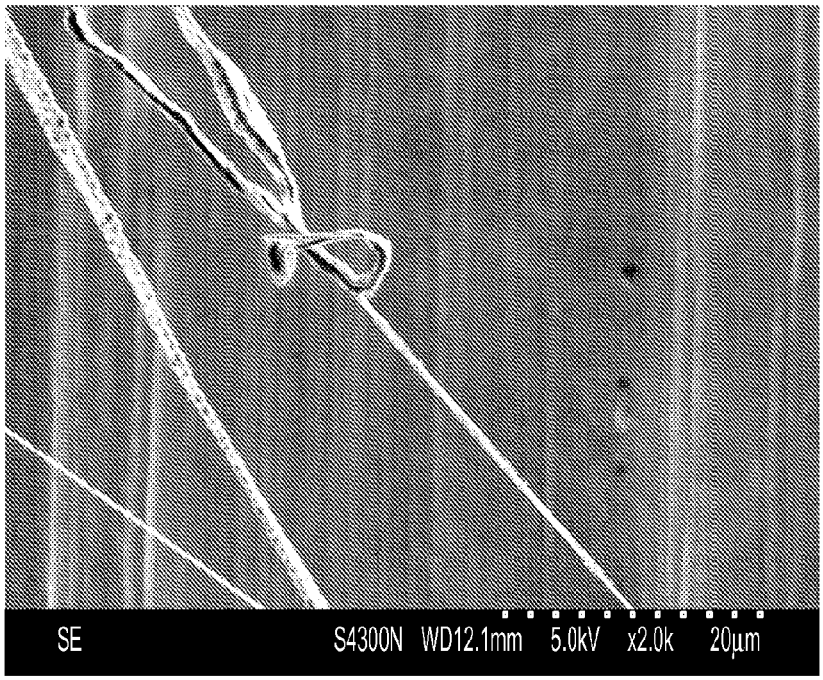
FIG. 27 depicts a photograph (2000×) of single fiber polyethylene oxide (PEO) superfine fibers of sub-micron and nano diameters, produced using melt spinning wherein a spinneret according to FIG. 1 was spun at 4,000 RPM at 50° C. (spinneret temperature) for 5 minutes, wherein fibers were collected on a superfine fiber collection device according to FIG. 10. The material that was spun was 5% by weight PEO in de-ionized water.
Figure 28:
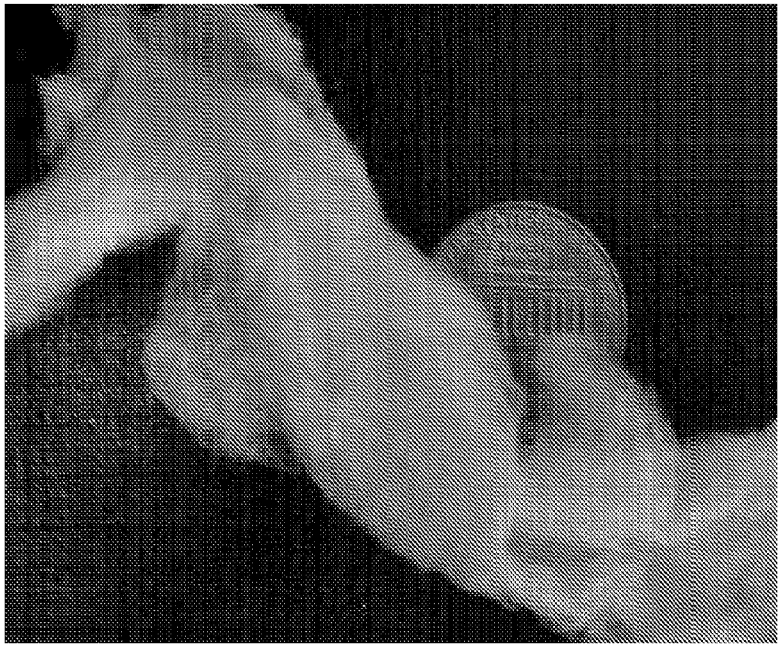
FIG. 28 depicts a photograph of mat polystyrene (PS) superfine fibers of single digit micron and nano diameters, produced using melt spinning wherein a spinneret according to FIG. 4 and FIG. 5 was spun at 5,000 RPM at 240° C. (spinneret temperature) for 5 minutes using a spinneret according to FIG. 1, wherein fibers were collected on a superfine fiber collection device according to FIG. 10. The material that was spun was PS 818 polystyrene from Total Petrochemicals.

FIG. 24 shows a cut-away perspective view of an apparatus that is substantially similar to the apparatus of FIG. 18 as well, but in addition to the collection wall 1812, collection rods 2401 are shown. Collection rods may be used in conjunction with a collection wall to collect superfine fibers, or each type of collection device may be used separately.

b. Control System

A control system of an apparatus (e.g., FIG. 18, 1822 and 1823) allows a user to change certain parameters (e.g., RPM, temperature, environment) to influence superfine fiber properties. One parameter may be changed while other parameters are held constant, if desired. One or more control boxes in an apparatus may provide various controls for these parameters, or certain parameters may be controlled via other means (e.g., manual opening of a valve attached to a housing to allow a gas to pass through the housing and into the environment of an apparatus). It should be noted that the control system can be integral to the apparatus (as shown in FIGS. 18-24) or can be disposed separately from the apparatus (e.g., can be modular with suitable electrical connections).

In certain methods described herein, material spun in a spinneret or heated structure may undergo varying strain rates, where the material is kept as a melt or solution. Since the strain rate alters the mechanical stretching of the superfine fibers created, final superfine fiber dimension and morphology may be significantly altered by the strain rate applied. Strain rates are affected by, for example, the shape, size, type and RPM of a spinneret. Altering the viscosity of the material, such as by increasing or decreasing its temperature or adding additives (e.g., thinner), may also impact strain rate. Strain rates may be controlled by a variable speed spinneret. Strain rates applied to a material may be varied by, for example, as much as 50-fold (e.g., 500 RPM to 25,000 RPM).

Temperatures of the material, spinneret and the environment may be independently controlled using a control system. The temperature value or range of values employed by the present methods typically depend on the application. For example, for many applications, temperatures of the material, spinneret and the environment typically range from −4° C. to 400° C. Temperatures may range as low as, for example, −20° C. to as high as, for example, 1500° C. For melt spinning of polymers, a spinneret temperature of 200° C. is used. For melt spinning involving metals, spinneret temperatures of 500° C. or higher may be used. For solution spinning, ambient temperatures of the spinneret are typically used. In drug development studies (see below), the spinneret temperature range may be between, for example, 4° C. and 80° C. When producing ceramic or metal superfine fibers, the temperatures utilized may be significantly higher. For higher temperatures, it will typically be necessary to make appropriate changes in the materials of the housing of an apparatus and/or the interior components (e.g., substitution of metal for plastic), or in the apparatus itself (e.g., addition of insulation). Such changes may also help avoid undesirable reactions, such as oxidation.

An example of how the variables discussed herein may be controlled and manipulated to create particular superfine fibers regards drug development. Solubility and stability of drugs are two key considerations in developing drug delivery systems. Both of these parameters may be simultaneously controlled using the methods and apparatuses described herein. Solubility of the drug is often significantly improved by controlling its size: that is, the smaller the size, the better the solubility. For example, micron-sized fibers of optically active beta-lactams may be developed from their crystals (see, e.g., Example 5). At this significantly reduced size, the solubility of the drug in water is expected to show significant improvement over larger sized drug particles due to the higher surface area. Moreover, one may dissolve a drug in an appropriate solvent that then evaporates, leaving behind a superfine fiber composed of the drug. One may also use the methods and apparatuses discussed herein to encapsulate such a drug in a material which is also spun, thereby forming a drug-encapsulated superfine fiber. To facilitate the stability of certain drugs, it may often be necessary to lower the temperature of the environment below ambient conditions. Since the housing of an apparatus may be designed with adequate insulation, temperatures may be lowered as needed, such as −10° C. or below.

C. Overview of Superfine Fiber Creation

Superfine fibers as discussed herein may be created using, for example, a solution spinning method or a melt spinning method. In both the melt and solution spinning methods, a material may be put into a spinneret which is spun at various speeds until fibers of appropriate dimensions are made. The material may be formed, for example, by melting a solute or may be a solution formed by dissolving a mixture of a solute and a solvent. Any solution or melt familiar to those of ordinary skill in the art may be employed. For solution spinning, a material may be designed to achieve a desired viscosity, or a surfactant may be added to improve flow, or a plasticizer may be added to soften a rigid superfine fiber. In melt spinning, solid granules may comprise, for example, a metal or a polymer, wherein polymer additives may be combined with the latter. Certain materials may be added for alloying purposes (e.g., metals) or adding value (such as antioxidant or colorant properties) to the desired superfine fibers.

Non-limiting examples of reagents that may be melted, or dissolved or combined with a solvent to form a material for melt or solution spinning methods include polyolefin, polyacetal, polyamide, polyester, cellulose ether and ester, polyalkylene sulfide, polyarylene oxide, polysulfone, modified polysulfone polymers and mixtures thereof. Non-limiting examples of solvents that may be used include oils, lipids and organic solvents such as DMSO, toluene and alcohols. Water, such as de-ionized water, may also be used as a solvent. For safety purposes, non-flammable solvents are preferred.

In either the solution or melt spinning method, as the material is ejected from the spinning spinneret, thin jets of the material are simultaneously stretched and dried in the surrounding environment. Interactions between the material and the environment at a high strain rate (due to stretching) leads to solidification of the material into fibers, which may be accompanied by evaporation of solvent. By manipulating the temperature and strain rate, the viscosity of the material may be controlled to manipulate the size and morphology of the superfine fibers that are created. A wide variety of superfine fibers may be created using the present methods, including novel fibers such as polypropylene (PP) nanofibers. Non-limiting examples of superfine fibers made using the melt spinning method include polypropylene, acrylonitrile butadiene styrene (ABS) and nylon. Non-limiting examples of superfine fibers made using the solution spinning method include polyethylene oxide (PEO) and beta-lactams.

Creation of fibers may take between a few seconds (e.g., 10-20) to several hours (e.g., 2-7), depending upon the type and amount of material used. The creation of fibers can be done in batch modes or in continuous modes. In the latter case, material can fed continuously into the spinneret and the process can be continued over days (e.g., 1-4) and even weeks (e.g., 2-4).

D. Examples

The following examples are included to demonstrate preferred embodiments of the present methods and apparatuses. Those of skill in the art should, in light of the present disclosure, appreciate that many changes can be made in the specific embodiments disclosed in these examples and still obtain a like or similar result without departing from the scope of the invention.

Example 1

Solution Spinning Method of Producing Polyethylene Oxide (PEO) Nanofibers

In this example, the material employed was a polymer of a particular molecular weight and the temperature of the spinneret was fixed, while the RPM and polymer concentration were both varied. Thus, the effects of RPM and polymer concentration on superfine fiber diameters and properties were tested.

A 3% by weight polyethylene oxide (PEO; MW=900,000 g/mol) in de-ionized (DI) water was prepared. The temperature for both the spinneret and the solution was maintained at 50° C. The temperature of the spinneret was measured using an IR sensor. A small beaker holding 25 mL of solution was placed on a standard heating/stirring unit and the temperature of the solution was brought to 50° C. To minimize evaporation, the beaker was covered with aluminum foil. The solution was kept in a refrigerator unless in use. The environment in which the superfine fibers were created was ambient air at ambient temperature. An aerodynamic wall (intermediate wall) was placed outside of the collection wall, such as shown in FIG. 18 through FIG. 22 at a distance of about 3" from the collection wall.

Procedure:

1. A spinneret according to FIG. 1 was preheated to 50° C. using a resistance heater, A commercially available IR sensor was used to monitor the temperature. The temperature was maintained by turning the heat on and off as needed. The temperature was achieved and maintained typically for roughly 10 minutes before proceeding.
2. About 50 mL of the PEO solution was dispensed into the pre-heated spinneret.
3. The spinneret was spun at 1,000 RPM for three minutes.
4. Superfine fibers collected on a superfine fiber collection device according to FIG. 10 (a collection wall).
5. Spinning was stopped.
6. The temperature of the spinneret was monitored (every 10 seconds) from start (that is, when the solution is added to the spinneret) to finish (that is, when spinning stopped) as the temperature of the spinneret typically decreased over time.
7. One or more glass slides (e.g., 6"×1.25"×1/16") were used to manually collect superfine fiber samples by scooping the superfine fibers away from the collection wall: one side of the slide was used to collect the fibers, while the other side was labeled as needed.
8. The sample may be saved in a desiccator, if desired.
9. The spinneret was disassembled and cleaned for the next experiment with warm tap water for 15 minutes, followed by a rinse with DI water.

10. The spinneret was reassembled and heated again to 50° C.
11. Steps 2-7 were repeated at 2,000, 3,000, 4,000 and 5,000 RPM.
12. Steps 1-9 were repeated using 5% and 7% PEO solutions.

Results:

This method afforded nanofibers. Typically, higher PEO concentrations led to thicker fibers and higher RPMs lead to thinner fibers.

Example 2

Melt Spinning Method of Producing Polystyrene (PS) Single Digit Micron Fibers

In this example, the amount of polymer was controlled, while the RPM was varied. Thus, the effects of RPM on the size and properties of the superfine fibers created were examined.

Polystyrene may be obtained from a variety of commercial sources in a variety of forms. Here, a commercially available product (white pellets) from Total Petrochemicals called PS 818 was employed. It is a high impact polystyrene (HIPS) that has a high heat resistance and is suitable for injection molding, extrusion and thermoforming. The environment in which the superfine fibers were created was ambient air at ambient temperature. An aerodynamic wall (intermediate wall) was placed outside of the collection wall, such as shown in FIG. 18 through FIG. 22 at a distance of about 3" from the collection wall.

Procedure:

1. 30 grams of PS 818 white pellets were melted in a crucible using a standard scientific heater with temperature control. Depending upon the grade and specific formulation, its melting temperature varied between 190° C. and 260° C.
2. Using a resistance heater, a spinneret according to FIG. 1 was heated to 240° C. to ensure that the polymer remained fluid in the spinneret. The temperature was not raised higher than 260° C. to avoid potential degradation. The temperature of the spinneret was measured using an IR sensor.
3. The molten material (30 mL) were dispensed into the heated spinneret.
4. The spinneret was spun at 1,000 RPM for up to three minutes.
5. Spinning was stopped.
6. The temperature of the spinneret was monitored every 10 seconds, as described in Example 1, step 5.
7. Superfine fibers were collected, as described in Example 1, step 6.
8. The marked sample was stored in a desiccator.
9. The spinneret was cleaned by heating it to 300° C. and spinning it at 6,000 RPM for few minutes.
10. The spinneret was reassembled, and for the next run, the RPM of the spinneret was increased by 500.
11. Steps 2-10 were repeated until the RPM reached 6,000 RPM.

Results:

Single digit micron fibers were produced. The best results were achieved at 240° C. and 4,500 RPM Example 3

Table of Exemplary Apparatuses and Uses Thereof

The following table depicts a variety of non-limiting exemplary apparatuses and possible uses thereof.

| Apparatus Type | Spinneret Type | Collection Method | Melt Spinning Solution Spinning, or Both | Maximum Spinneret Temperature (° C.) | Minimum Spinneret Temperature (° C.) | Spinneret RPM Range | Superfine Fiber Environment | Non-limiting Example of Use |
|---|---|---|---|---|---|---|---|---|
| 1 | FIGS. 1, 2, 4, 6, 8, 9 | Wall and/or rod | Both | 400 | Ambient | 500-25,000 | Ambient | Polymers and their alloys |
| 2 | FIGS. 1, 2, 4, 6, 8, 9 | Wall and/or rod, preferably wall | Both | 400 | −20° C. | 500-6,000 | Ambient | Food industry and biopolymers |
| 3 | FIGS. 1, 2, 8, 9 | Wall and/or rod | Both, but typically melt spinning | 1,000 | Ambient | 500-6,000 | Ambient | Low melting metals |
| 4 | FIGS. 1, 2, 8, 9 | Wall and/or rod | Both, but typically melt spinning | 1,500 | Ambient | 500-10,000 | Ambient, heated, or cooled; optional introduction of gas | High melting metals and alloys |
| 7 | FIGS. 4, 6 | Wall and/or rod, preferably wall | Solution spinning | 400 | −20° C. | 500-6,000 | Sterile | Drug and drug delivery system development |
| 8 | FIGS. 1, 2, 4, 6, 8, 9 | Wall and/or rod | Both | Custom | Custom | Custom | Custom | Custom |

Example 4

Method of Producing Acrylonitrile Butadiene Styrene Nanofibers

Acrylonitrile Butadiene Styrene (ABS) may be obtained from a variety of commercial sources in a variety of forms. Here, a commercially available product (off-white pellets) from Star Plastic was employed. The specific grade of ABS chosen was a recycled grade suitable for injection molding. The environment in which the superfine fibers were created was ambient air at ambient temperature. Superfine fibers were collected on the collection wall and the spinneret was a spinneret according to FIG. 1. An aerodynamic wall was placed outside of the collection wall, such as shown in FIG. 18 through FIG. 22 at a distance of about 3" from the collection wall.

Procedure:

1. 300 grams of gray ABS pellets were melted in a crucible using a standard scientific heater with temperature control. Depending upon the grade and specific formulation, its melting temperature varied between 210° C. and 280° C.
2. Using a resistance heater, the spinneret initial temperature and RPM were set at 200° C. and 500 RPM, respectively.
3. The temperature of the spinneret was continually measured every 10 seconds using an IR sensor and adjusted to the desired temperature as necessary.
4. About 30 mL molten material was dispensed into the heated spinneret to start the experiment.
5. The spinneret was set to spinning at 500 RPM.
6. Temperature was increased by another 10° C. unless it was more than 300° C. In that case go to Step 25.
7. RPM of the spinneret was increased by another 500 RPM unless the RPM exceeded 6,000. In that case go to Step 16.
8. Spinneret was spun at the set RPM and temperature for up to three minutes.
9. Spinning was stopped.
10. Collecting wall is inspected for superfine fibers. If there are no fibers found make a note and go to Step 18.
11. Superfine fibers were collected, as described in Example 1, step 6.
12. The marked sample was stored in a desiccator.
13. Go to Step 18.
14. The spinneret was cleaned by heating it to 350° C. or slightly higher and spinning it at 6,000 RPM for few minutes.
15. The spinneret was reassembled and made ready for the next run.

Results:

Most of the fibers were micron size fibers. Optimal conditions for superfine fiber production were around 280° C. and 4,500 RPM.

Example 5

Method of Producing Beta-Lactam Superfine Fibers

There are several formulations for beta-lactams that are commercially available or that may be prepared using known synthetic methods. Here, crystalline powders of a specific formulation called Optically Inactive Beta-Lactam (OIBL) was used to develop Beta-Lactam Superfine Fibers (BLSF). Samples were donated by Professor Bimal Banik, The University of Texas, Pan American, Department of Chemistry. A 3% by weight OIBL brown powder was dissolved in DMSO (dimethyl sulfoxide) at room temperature (RT) in a beaker with the help of magnetic stirrer. To minimize evaporation, 30 mL of the solution was kept covered in a beaker with wax paper. Other solutions with varying concentrations of 1%, 5%, 7%, 9% and 10% were similarly made and kept covered at RT. All the solutions were used during these experiments. The environment in which the superfine fibers were created was ambient air at ambient temperature. A spinneret according to FIG. 1 was used and a superfine fiber collection device according to FIG. 10 was used. An aerodynamic wall was placed outside of the collection wall, such as shown in FIG. 18 through FIG. 22 at a distance of about 3" from the collection wall.

Procedure:

1. The 30 mL OIBL/DMSO solution was poured into the spinneret, where the spinneret was at RT.
2. The experiment commenced with the 30 mL OIBL/DMSO solution with 3% concentration.
3. RPM for the spinneret was set at 0 RPM.
4. The spinneret was re-set at 1,000 RPM higher than the previous set RPM.
5. If the new re-set RPM was more than 5,000 go to step 10.
6. Spin the spinneret for three minutes.
7. Spinning was stopped to collect superfine fibers.
8. One or more glass slides (e.g., 6"×1.25"×1;16") was used to manually collect superfine fiber samples by scooping out the superfine fibers from the collection wall. One side of the slide was used to collect the fibers, while the other side was labeled as needed.
9. The sample was saved in a desiccator.
10. Steps 3 through 8 were repeated.
11. Repeat the experiment with next higher concentration by re-setting RPM at 0 and following Steps 3 through 9. If all the solutions were used up go next to Step 11.
12. The spinneret was disassembled and cleaned for the next experiment with warm tap water for 15 minutes, followed by a rinse with DI water.

Results:

Most of the experiments did not yield superfine fibers in high quantities. Solutions typically were sputtered over the collection wall. However, in certain cases, there was as mixture of few superfine fibers with a large quantity of sputtered solution. Best results were obtained using a 5% solution at 4,000 RPM. Scrutiny under optical microscopes at 200× showed that they were mostly micron size fibers.

Example 6

Method of Producing Polycarbonate Superfine Fibers

There are several formulations for polycarbonate that are commercially available or that may be prepared using known synthetic methods. Here, bulk polycarbonate beads were used to develop Polycarbonate Superfine Fibers by the melt spinning methods described herein. The environment in which the superfine fibers were created was ambient air at a temperature below the melting temperature of the polymer (polycarbonate). It was attempted to keep the temperature of this ambient air at RT, such as, for example, by introducing cooling air by way of an opening (e.g., 1816 in FIG. 18) in the housing. However, in certain repetitions of the procedure below, the temperature of the ambient air rose to as much as 70° C. In certain repetitions of the procedure below, a spinneret according to FIG. 1 was used and, in others, a superfine fiber collection device according to FIG. 8 was used. An aerodynamic wall was placed outside of the collection wall, such as shown in FIG. 18 through FIG. 22 at a distance of about 3" from the collection wall.

While many polymers have found applications in various industries, polycarbonate can be particularly attractive for certain applications because of its high strength (including impact), optical clarity, and biocompatibility. Polycarbonate's usage in medical device industry can also make it particularly attractive for medical applications such as, for example, medical devices, implants, and even, drug delivery devices. Some applications for polycarbonate superfine fibers, for example, can include electret filters, biocompatible nanofilters and potential bio-absorbers. Polycarbonate may also be suitable for bio-absorbers, for example, when mixed with appropriate bio-absorbents like agarose, as discussed in more detail below. Additionally, the ability to sterilize polycarbonate by radiation can be an attractive feature for medical applications.

Procedure:

1 Melted (molten) polycarbonate was spun in the spinneret, where the spinneret was at a temperature above the melting temperature of the polycarbonate, but below the degradation temperature of the polycarbonate, such as, for example 300° C., 350° C., and/or 300-350° C.
2. RPM for the spinneret was set at 0 RPM.
3. The spinneret was re-set to rotate at a rate, such as, for example, 1,000 RPM, 5,000 RPM, 3,000 RPM, 4,000 RPM, and/or 1,000-5,000 RPM.
4. The spinneret was spun for a period of time, such as, for example, three (3) minutes, thirty (30) minutes, and/or 3-30 minutes.
5. Spinning was stopped to collect superfine fibers.
6. Steps 3 through 5 were repeated.

Figure 29:
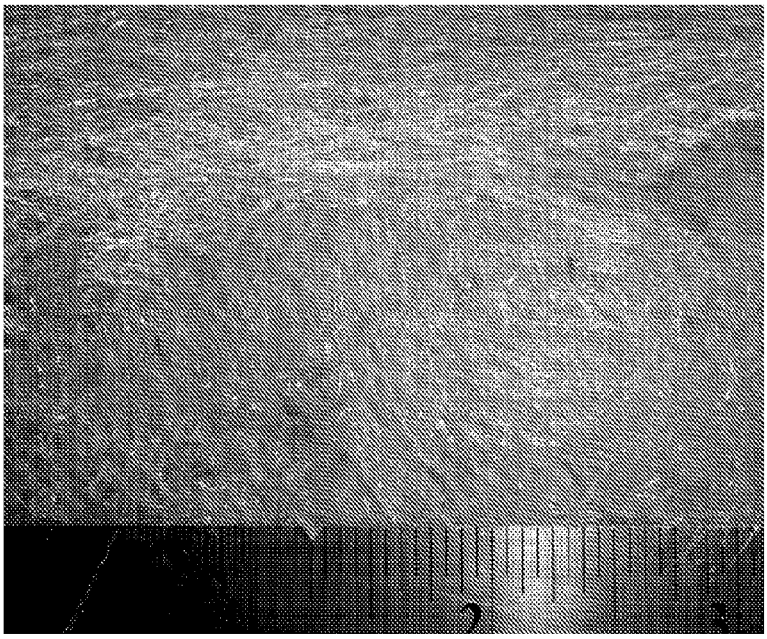
FIG. 29 depicts a photograph of polycarbonate superfine fibers.

Results:

Resulting fibers included single-digit microfibers to nanofibers. One sample of resulting superfine fibers is depicted in FIG. 29.

Example 7

Method of Producing Composite Superfine Fibers

In some embodiments, composite fibers are made by mechanically mixing polymers prior to and/or during melting prior to spinning. For example, a primary polymer (e.g., ≥50% of mixture) can be mechanically mixed with a secondary or blend polymer (e.g., ≤50% of mixture), such as, for example, before melting the polymers. Where it is desired to limit to interaction between the polymers to a mechanical interaction (rather than a chemical interaction), the secondary polymer can be one that does not chemically interact with the primary polymer.

For purposes of this example, polycarbonate was used for the primary polymer and blue polymer dye was used for the secondary polymer. In other embodiments, the primary polymers can be any suitable polymers, such as, for example, the polymers mentioned in this disclosure (e.g., PS, PP, ABS, Agarose, and the like). Similarly, in other embodiments, the secondary polymer can be any suitable polymer (or other material), such as, for example, the polymers mentioned in this disclosure (e.g., PS, PP, ABS, Agarose, and the like). The mixture included about 95% polycarbonate and about 5% blue dye. Composite Superfine Fibers were then created by the melt spinning methods described herein, where the temperature of the spinneret (and the mixture) was maintained at a temperature above the highest melting point of the polymers, and below the lowest degradation temperature of the two polymers. The environment in which the superfine fibers were created was ambient air at a temperature below the melting temperature of the mixture (e.g., polycarbonate and dye). It was attempted to keep the temperature of this ambient air at RT, such as, for example, by introducing cooling air by way of an opening (e.g., 1816 in FIG. 18) in the housing. However, in certain repetitions of the procedure below, the temperature of the ambient air rose to as much as 70° C. In certain repetitions of the procedure below, a spinneret according to FIG. 1 was used and, in others, a superfine fiber collection device according to FIG. 8 was used. An aerodynamic wall was placed outside of the collection wall, such as shown in FIG. 18 through FIG. 22 at a distance of about 3" from the collection wall.

Procedure:

1. Melted (molten) mixture of polycarbonate and blue polymer dye was spun in the spinneret, with the spinneret at a temperature above the melting temperature of the polycarbonate, but below the degradation temperature of the polycarbonate, such as, for example 300° C., 350° C., and/or 300-350° C.
2. RPM for the spinneret was set at 0 RPM.
3. The spinneret was re-set to rotate at a rate, such as, for example, 1,000 RPM, 5,000 RPM, 3,000 RPM, 4,000 RPM, and/or 1,000-5,000 RPM.
4. The spinneret was spun for a period of time, such as, for example, three (3) minutes, thirty (30) minutes, and/or 3-30 minutes.
5. Spinning was stopped to collect superfine fibers.
6. Steps 3 through 5 were repeated.

Figure 30:
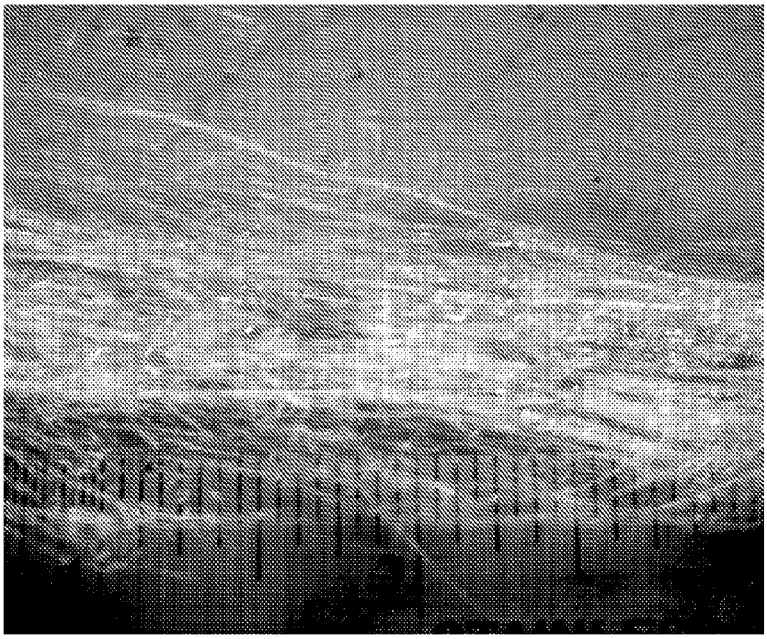
FIG. 30 depicts a photograph of composite superfine fibers comprising polycarbonate and blue dye.

Results:

Resulting fibers included single-digit microfibers to nanofibers. One sample of resulting superfine fibers is depicted in FIG. 30.

All of the methods and apparatuses disclosed and claimed herein can be made and executed without undue experimentation in light of the present disclosure. Descriptions of well known processing techniques, components and equipment have been omitted so as not to unnecessarily obscure the present methods and apparatuses in unnecessary detail. The descriptions of the present methods, devices and systems are exemplary and non-limiting. Certain substitutions, modifications, additions and/or rearrangements falling within the scope of the claims, but not explicitly listed in this disclosure, may become apparent to those of ordinary skill in the art based on this disclosure. Furthermore, it will be appreciated that in the development of a working embodiment, numerous implementation-specific decisions must be made to achieve the developers' specific goals, such as compliance with system-related and business-related constraints, which will vary from one implementation to another. While such a development effort might be complex and time-consuming, it would nonetheless be a routine undertaking for those of ordinary skill in the art having the benefit of this disclosure. Additionally, it will be apparent that certain agents that are both chemically and physiologically related may be substituted for the agents described herein while the same or similar results would be achieved. All such similar substitutes and modifications apparent to those skilled in the art are within the scope of the invention as defined by the appended claims. For example, in certain embodiments, spinnerets are shown as having four openings. In other embodiments, they have seven openings. As another example, some apparatuses are shown has having three collection rods. In other embodiments, there are twelve. As yet another example, spinnerets are shown as rotating clockwise, in certain embodiments. In other embodiments, the spinnerets rotate counter-clockwise.

The claims are not to be interpreted as including means-plus- or step-plus-function limitations, unless such a limitation is explicitly recited in a given claim using the phrase(s) "means for" or "step for," respectively.

REFERENCES

The following references, to the extent that they provide exemplary procedural or other details supplementary to those set forth herein, are specifically incorporated herein by reference.

U.S. Pat. No. 4,043,331
U.S. Pat. No. 4,044,404
U.S. Pat. No. 4,266,918

U.S. Pat. No. 4,323,525
U.S. Pat. No. 4,639,390
U.S. Pat. No. 4,657,743
U.S. Pat. No. 4,842,505
U.S. Pat. No. 5,522,879
U.S. Pat. No. 6,106,913
U.S. Pat. No. 6,111,590
U.S. Pat. No. 6,221,487
U.S. Pat. No. 6,235,392
U.S. Pat. No. 6,511,930
U.S. Pat. No. 6,596,033
U.S. Pat. No. 6,616,435
U.S. Pat. No. 6,713,011
U.S. Pat. No. 7,067,444
U.S. Pat. No. 7,083,854
U.S. Pat. No. 7,134,857

What is claimed:

1. A method of creating fibers comprising:

placing material to be formed into fibers in a spinneret, the spinneret comprising a top portion and a bottom portion, the top portion and the bottom portion together defining an internal cavity which receives the material to be formed into fibers, wherein when the top portion is coupled to the bottom portion one or more openings exist at the interface of the top portion and the bottom portion;

rotating the spinneret about a spin axis such that rotation of the spinneret causes at least a portion of the material disposed in the spinneret to be ejected through the one or more of the openings and form the fibers as the ejected material solidifies.

2. The method of claim 1, further comprising: heating the material to a temperature sufficient to at least partially melt the material; and placing the heated material in the spinneret.

3. The method of claim 1, further comprising: placing material in the spinneret; and heating the spinneret to a temperature at or near the temperature sufficient to at least partially melt the material disposed in the spinneret.

4. The method of claim 1, further comprising mixing the material with a solvent to produce a mixture of the material in a solvent, and placing the mixture in the spinneret.

5. The method of claim 1, wherein the bottom portion defines a concave internal cavity and wherein the internal cavity receives the material to be formed into fibers.

6. The method of claim 1, wherein the openings have a size that promotes the formation of microfibers.

7. The method of claim 1, wherein the openings have a size that promotes the formation of nanofibers.

8. The method of claim 1, further comprising collecting the fibers on a collection device that at least partially surrounds the spinneret while the spinneret is being rotated.

9. The method of claim 1, further comprising heating the spinneret with a heater thermally coupled to the spinneret.

10. The method of claim 1, further comprising surrounding the spinneret in a housing, wherein the environment in the housing is controllable.

11. The method of claim 1, wherein the top portion and the bottom portion of the spinneret spin together in a fixed relation to each other when the spinneret is rotated.

12. The method of claim 1, wherein at least a portion of the superfine fibers are created without electrospinning.

13. The method of claim 1, wherein the fibers are formed without subjecting the material to an externally-applied electric field that is sufficient to draw a fiber from the openings of the spinneret.

14. The method of claim 1, wherein the fibers are formed without subjecting the material to an externally-applied gas.

15. The method of claim 1, wherein the fibers are formed without the fibers falling into liquid after being created.

16. The method of claim 1, wherein the top portion is separable from the bottom portion.

17. The method of claim 1, wherein the produced fibers have a length of 1 micron or longer.

18. The method of claim 1, wherein the material comprises a metal.

19. The method of claim 1, wherein the material comprises a polymeric material.

* * * * *